US008552940B2

(12) United States Patent
Nakamura et al.

(10) Patent No.: US 8,552,940 B2
(45) **Date of Patent: *Oct. 8, 2013**

(54) DISPLAY DEVICE AND DRIVING METHOD THEREOF

(75) Inventors: Mika Nakamura, Osaka (JP); Kenichi Masumoto, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/523,428

(22) Filed: Jun. 14, 2012

(65) Prior Publication Data

US 2012/0249612 A1 Oct. 4, 2012

Related U.S. Application Data

(63) Continuation of application No. 12/713,491, filed on Feb. 26, 2010, now Pat. No. 8,223,094, which is a continuation of application No. PCT/JP2009/002303, filed on May 26, 2009.

(30) Foreign Application Priority Data

May 29, 2008 (JP) ..... 2008-141715

(51) Int. Cl.
*G09G 3/30* (2006.01)

(52) U.S. Cl.
USPC ..... 345/78; 345/214; 345/82; 345/204

(58) Field of Classification Search
USPC ..... 345/76–83, 204–206, 208–210, 214, 345/215, 690; 250/552, 553; 313/463, 498, 313/506, 512; 315/169.1, 169.3, 169.4, 690
See application file for complete search history.

(56) References Cited

U.S. PATENT DOCUMENTS

| | | | | |
|---|---|---|---|---|
| 7,193,589 | B2 | 3/2007 | Yoshida et al. | |
| 7,423,617 | B2 * | 9/2008 | Giraldo et al. | 345/82 |
| 7,564,452 | B2 | 7/2009 | Komiya | |
| 7,999,800 | B2 * | 8/2011 | Iwabuchi et al. | 345/204 |
| 8,223,094 | B2 * | 7/2012 | Nakamura et al. | 345/78 |
| 2002/0181276 | A1 * | 12/2002 | Yamazaki | 365/175 |
| 2003/0111966 | A1 | 6/2003 | Mikami et al. | |
| 2003/0160745 | A1 | 8/2003 | Osame et al. | |
| 2003/0214245 | A1 | 11/2003 | Yamazaki et al. | |

(Continued)

FOREIGN PATENT DOCUMENTS

| | | |
|---|---|---|
| JP | 2004-126501 | 4/2004 |
| JP | 2004-279548 | 10/2004 |
| JP | 2006-309119 | 11/2006 |
| JP | 3993117 | 8/2007 |

*Primary Examiner* — Tom Sheng
(74) *Attorney, Agent, or Firm* — Greenblum & Bernstein, P.L.C.

(57) ABSTRACT

A display device includes luminescence pixels that each include a driving transistor, a luminescence element, and a switching transistor that switches between conduction and non-conduction between a data line and an anode or a cathode of the luminescence element. A data driving circuit supplies a signal voltage to the data line, and a bias supplying circuit supplies a predetermined bias voltage to the data line. A controller applies the predetermined bias voltage to the anode or the cathode of the luminescence element by causing a non-conduction state between the data line and the data driving circuit, causing a conduction state between the data line and the bias supplying circuit, and switching the switching transistor ON within a period in which a signal current does not flow to the luminescence element.

9 Claims, 12 Drawing Sheets

(56) References Cited

U.S. PATENT DOCUMENTS

| | | | | |
|---|---|---|---|---|
| 2004/0263437 | A1* | 12/2004 | Hattori | 345/76 |
| 2004/0263503 | A1 | 12/2004 | Seki | |
| 2005/0017928 | A1 | 1/2005 | Osame et al. | |
| 2005/0030265 | A1 | 2/2005 | Miyagawa | |
| 2005/0068273 | A1 | 3/2005 | Suzuki | |
| 2005/0168491 | A1 | 8/2005 | Takahara et al. | |
| 2006/0244695 | A1 | 11/2006 | Komiya | |
| 2007/0046593 | A1 | 3/2007 | Shin | |
| 2008/0150846 | A1* | 6/2008 | Chung | 345/80 |
| 2009/0073153 | A1 | 3/2009 | Yamate | |
| 2009/0219272 | A1 | 9/2009 | Nakata et al. | |

* cited by examiner

DISPLAY DEVICE AND DRIVING METHOD THEREOF

CROSS REFERENCE TO RELATED APPLICATION

The present application is a continuation application of U.S. patent application Ser. No. 12/713,491 filed on Feb. 26, 2010, which is a continuation application of PCT Application No. PCT/JP2009/002303 filed May 26, 2009, designating the United States of America, the disclosure of each of which, including the specification, drawings, and claims, is incorporated herein by reference in its entirety.

The disclosure of Japanese Patent Application No. 2008-141715 filed on May 29, 2008, including specification, drawings, and claims, is also incorporated herein by reference in its entirety.

BACKGROUND OF THE INVENTION

1. Field of the Invention

The present invention relates to display devices and driving methods thereof, and particularly to a display device using current-driven luminescence elements, and a driving method thereof.

2. Description of the Related Art

Conventionally, advancements in brightness, vividness, flatness, lightness, and increased surface area have been demanded of display devices, and technological development has also been progressing steadily. To satisfy the requirements of flatness, lightness, and increased surface area, liquid crystal displays and plasma displays have been introduced to the market, and continue to evolve even after more than ten years have passed since the start of commercialization.

In view of such an environment, recent years have seen the commercialization of displays using electroluminescence (referred to hereafter as EL) which allows luminescence intensity to be controlled according to the amount of current and which has an extremely fast response speed, and technological development has been progressing dramatically. In particular, organic EL displays using organic EL elements, which have excellent viewing angle characteristics, and are bright and vivid, have attracted attention as next-generation flat-panel displays having the advantage of low power consumption.

However, in the case of the above-mentioned current-driven organic EL display, brightness deterioration, which advances with the application of current to the organic EL elements, is particularly prominent. In order to restore organic EL elements affected by such brightness deterioration, a method of applying reverse bias voltage to the organic EL elements has been widely used, and Patent Reference 1 (Japanese Patent No. 3993117) discloses a circuit configuration for applying reverse bias voltage to EL elements.

FIG. 12 is a circuit diagram of a luminescence pixel in a conventional display device disclosed in Patent Reference 1. A display device 500 in the figure includes a luminescence element 501. FETs 502, 503, 504, and 505, a capacitance element 506, a data line 507, and control lines 508, 509, 510, and 511.

Signal voltage is supplied to the luminescence pixel from a data driver circuit not shown in the figure, via the data line 507. At this time, when the FET 503 is turned ON according to the voltage control from the control line 508, the signal voltage is applied to a gate of the FET 502, and a signal current corresponding to the signal voltage flows to the luminescence element 501 through the FET 502. Next, even when the FET 503 is turned OFF, the luminescence element 501 continues producing luminescence with a brightness corresponding to the voltage charged between both terminals of the capacitance element 506. In this manner, the basic display operation of the display device 500 is executed by the luminescence element 501, the FETs 502 and 503, the capacitance element 506, the data line 507, and the control line 508.

In addition to the above-described basic operation, in order to reverse the brightness deterioration in the luminescence element 501, a reverse bias voltage is applied to an anode of the luminescence element 501 while the signal current does not flow to the luminescence element 501. For example, when there is a short between both terminals of the capacitance element 506 according to the voltage control from the control line 509, the gate voltage of the FET 502 becomes Vss, and the FET 502 is turned OFF. During this period, the FET 505 is turned ON according to the voltage control from the control line 510. Measures to reverse the brightness deterioration in the luminescence element 501 are taken by applying a reverse bias voltage to the anode of the luminescence element 501, via the control line 511, at the same time as the FET 505 is turned ON.

SUMMARY OF THE INVENTION

However, in Patent Reference 1, in order to apply the reverse bias to the luminescence element 501, the FET 504 and the control line 509 thereof for cutting-off the forward current flowing to the luminescence element 501, as well as the FET 505 and the control lines 510 and 511 thereof for applying the reverse bias have been added. In other words, a total of two transistors and three control lines have been added to the basic pixel circuit for luminescence production.

In the case of the above-described circuit configuration, although application of reverse bias voltage to the luminescence element is possible, the increase in the components in the pixel configuration leads to a reduction in manufacturing yield. In addition, when control lines increase, mutual interference between data lines and control lines increases since the data lines intersect with plural control lines. As a result of causing an increase in wiring load, such mutual interference becomes the cause for display unevenness attributable to the deterioration of the signal waveform of the data lines.

In view of the aforementioned problem, the present invention has as an object to provide a display device and a driving method thereof, which can implement the reversing of brightness deterioration in the EL element while maintaining display quality, and which has a simple pixel circuit configuration that does not reduce manufacturing yield.

In order to achieve the aforementioned object, the display device according to an aspect of the present invention is a display device including: luminescence pixels arranged in a matrix; data lines for determining luminescence of the luminescence pixels; write control lines for controlling writing of a signal voltage to the luminescence pixels; and bias control lines for controlling application of a predetermined bias voltage to the luminescence pixels, wherein each of the luminescence pixels includes: a first transistor (i) which has one of a source terminal and a drain terminal connected to a first power source terminal, and (ii) which converts, into a signal current, a signal voltage supplied via a data line included in the data lines; a second transistor (i) which has a gate terminal connected to a first write control line included in the write control lines, one of a source terminal and a drain terminal connected to the data line, and the other of the source terminal and the drain terminal connected to a gate terminal of the first transistor, and (ii) which switches between conduction and non-conduction between the data line and the gate terminal of the first transistor; a capacitance element which has one of terminals connected to the gate terminal of the first transistor, and the other one of the terminals connected to a second write control line for controlling writing of a signal voltage to a luminescence pixel in an immediately preceding row; a luminescence element (i) which has one of an anode and a cathode connected to the other of the source terminal and the drain terminal of the first transistor, and the other of the anode and the cathode connected to a second power source terminal, and (ii) which produces luminescence according to a flow of the signal current resulting from the conversion by the first transistor; and a third transistor (i) which has a gate terminal connected to a first bias control line included in the bias control lines, one of a source terminal and a drain terminal connected to the data line, and the other of the source terminal and the drain terminal connected to the one of the anode and the cathode of the luminescence element, and (ii) which switches between conduction and non-conduction between the data line and the luminescence element, and the display device further includes: a data driving circuit which supplies the signal voltage to the data line; a bias supplying circuit which supplies the predetermined bias voltage to the data line; and a control unit configured (i) to turn OFF the first transistor by changing voltage in the second write control line, (ii) to cause non-conduction between the data line and the data driving circuit and conduction between the data line and the bias supplying circuit, and (iii) to cause application of the predetermined bias voltage to the one of the anode and the cathode of the luminescence element by turning ON the third transistor by changing voltage in the first bias control line, the (ii) causing of non-conduction and conduction and the (iii) causing of application of the predetermined bias voltage being performed within a period in which the signal current does not flow to the luminescence element as a result of the (i) turning OFF of the first transistor.

With this, the signal voltage for element luminescence production and the bias voltage for element deterioration reversing can be supplied to the luminescence pixel using the same data line, and thus the increase in the control lines accompanying the application of bias to the luminescence element is suppressed. Therefore, since a predetermined bias voltage can be applied to the luminescence elements at a time when luminescence is not produced, without reducing manufacturing yield, it becomes possible to reverse brightness deterioration.

In addition, with this, the voltage level of the capacitance element which controls the turning ON/OFF of the first transistor which is a driving transistor is controlled through the write control line of the luminescence pixel in the preceding stage which is a basic circuit component, and thus there is no need to provide a switching transistor or a dedicated control line for controlling the voltage level of the capacitance element. Therefore, since a predetermined bias voltage can be applied to the luminescence element at a time when luminescence is not produced, without reducing manufacturing yield, it becomes possible to reverse brightness deterioration in the luminescence element.

Furthermore, the display device according to another aspect of the present invention is a display device including: luminescence pixels arranged in a matrix; data lines for determining luminescence of the luminescence pixels; write control lines for controlling writing of a signal voltage to the luminescence pixels; and bias control lines for controlling application of a predetermined bias voltage to the luminescence pixels; and luminescence control lines for controlling the luminescence of luminescence elements, wherein each of the luminescence pixels includes: a first transistor (i) which has one of a source terminal and a drain terminal connected to a first power source terminal, and (ii) which converts, into a signal current, a signal voltage supplied via a data line included in the data lines; a second transistor (i) which has a gate terminal connected to a first write control line included in the write control lines, one of a source terminal and a drain terminal connected to the data line, and the other of the source terminal and the drain terminal connected to a gate terminal of the first transistor, and (ii) which switches between conduction and non-conduction between the data line and the gate terminal of the first transistor; a capacitance element which has one of terminals connected to the gate terminal of the first transistor, and the other one of the terminals connected to a first luminescence control line included in the luminescence control lines; a luminescence element included in the luminescence elements, (i) which has one of an anode and a cathode connected to the other of the source terminal and the drain terminal of the first transistor, and the other of the anode and the cathode connected to a second power source terminal, and (ii) which produces luminescence according to a flow of the signal current resulting from the conversion by the first transistor; and a third transistor (i) which has a gate terminal connected to a first bias control line included in the bias control lines, one of a source terminal and a drain terminal connected to the data line, and the other of the source terminal and the drain terminal connected to the one of the anode and the cathode of the luminescence element, and (ii) which switches between conduction and non-conduction between the data line and the luminescence element, and the display device further includes: a data driving circuit which supplies the signal voltage to the data line; a bias supplying circuit which supplies the predetermined bias voltage to the data line; and a control unit configured (i) to turn OFF the first transistor by changing voltage in the first luminescence control line, (ii) to cause non-conduction between the data line and the data driving circuit and conduction between the data line and the bias supplying circuit, and (iii) to cause application of the predetermined bias voltage to the one of the anode and the cathode of the luminescence element by turning ON the third transistor by changing voltage in the first bias control line, the (ii) causing of non-conduction and conduction and the (iii) application of the predetermined bias voltage being performed within a period in which the signal current does not flow to the luminescence element as a result of the (i) turning OFF of the first transistor.

With this, the signal voltage for element luminescence production and the bias voltage for element deterioration reversing can be supplied to the luminescence pixel using the same data line, and thus the increase in the control lines accompanying the application of bias to the luminescence element is suppressed. Therefore, since a predetermined bias voltage can be applied to the luminescence elements at a time when luminescence is not produced, without reducing manufacturing yield, it becomes possible to reverse brightness deterioration.

In addition, with this, the voltage level of the capacitance element which controls the turning ON/OFF of the driving transistor is controlled through the first luminescence control line, and thus there is no need to provide a switching transistor for controlling the voltage level of the capacitance element. Therefore, since a predetermined bias voltage can be applied to the luminescence element at a time when luminescence is not produced, without reducing manufacturing yield, it becomes possible to reverse brightness deterioration in the luminescence element. Furthermore, since the first luminescence control line is added specifically for restoring the brightness of the luminescence element, it is sufficient for the control voltage levels of the first luminescence control line to be a binary for turning the first transistor ON and OFF, and thus the driving circuit for the control line can be simplified.

Furthermore, the display device according to another aspect of the present invention is a display device including: luminescence pixels arranged in a matrix; data lines for determining luminescence of the luminescence pixels; write control lines for controlling writing of a signal voltage to the luminescence pixels; and bias control lines for controlling application of a predetermined bias voltage to the luminescence pixels, wherein each of the luminescence pixels includes: a first transistor (i) which has one of a source terminal and a drain terminal connected to a first power source terminal, and (ii) which converts, into a signal current, a signal voltage supplied via a data line included in the data lines; a second transistor (i) which has a gate terminal connected to a first write control line included in the write control lines, one of a source terminal and a drain terminal connected to the data line, and the other of the source terminal and the drain terminal connected to a gate terminal of the first transistor, and (ii) which switches between conduction and non-conduction between the data line and the gate terminal of the first transistor; a capacitance element which has one of terminals connected to the gate terminal of the first transistor, and the other one of the terminals connected to the one of the source terminal and the drain terminal of the first transistor; a luminescence element (i) which has one of an anode and a cathode connected to the other of the source terminal and the drain terminal of the first transistor, and the other of the anode and the cathode connected to a second power source terminal, and (ii) which produces luminescence according to a flow of the signal current resulting from the conversion by the first transistor; and a third transistor (i) which has a gate terminal connected to a first bias control line included in the bias control lines, one of a source terminal and a drain terminal connected to the data line, and the other of the source terminal and the drain terminal connected to the one of the anode and the cathode of the luminescence element, and (ii) which switches between conduction and non-conduction between the data line and the luminescence element, the predetermined bias voltage is a voltage which turns OFF the first transistor when applied to the gate terminal of the first transistor, and the display device further includes: a data driving circuit which supplies the signal voltage to the data line; a bias supplying circuit which supplies the predetermined bias voltage to the data line; and a control unit configured (i) to cause non-conduction between the data line and the data driving circuit and conduction between the data line and the bias supplying circuit, and (ii) to turn ON the second transistor and turn OFF the first transistor by changing voltage in the first write control line, and (iii) to cause application of the predetermined bias voltage to the one of the anode and the cathode of the luminescence element by turning ON the third transistor by changing voltage in the first bias control line in synchronization with a period in which the signal current does not flow to the luminescence element as a result of the (i) causing of non-conduction and conduction and the (ii) turning ON and OFF, the (i) causing of non-conduction and conduction and the (ii) turning ON and OFF being performed simultaneously.

With this, the signal voltage for element luminescence production and the bias voltage for element deterioration reversing can be supplied to the luminescence pixel using the same data line, and thus the increase in the control lines accompanying the application of bias to the luminescence element is suppressed. Therefore, since a predetermined bias voltage can be applied to the luminescence elements at a time when luminescence is not produced, without reducing manufacturing yield, it becomes possible to reverse brightness deterioration.

In addition, with this, the bias voltage applied to the luminescence element is voltage-adjusted so as to become the gate voltage value which turns OFF the first transistor, and thus turning OFF the first transistor using the changing the voltage of the capacitance element is unnecessary. Specifically, at the time when bias voltage is applied to the luminescence element, the reverse bias voltage is also applied simultaneously to the gate of the first transistor. Therefore, since there is no need to provide a control line for changing the voltage level of the capacitance element, a predetermined bias voltage can be applied to the luminescence element at a time when luminescence is not produced, without reducing manufacturing yield, and thus it becomes possible to reverse brightness deterioration in the luminescence element.

Furthermore, the predetermined bias voltage may be a voltage for applying reverse bias to the luminescence element.

With this, it becomes possible to restore the brightness of the luminescence element that has deteriorated with the passage of time.

Furthermore, the predetermined bias voltage may be a voltage for applying a 0-volt bias to the luminescence element.

With this, the anode and the cathode of the luminescence element will have the same potential and the luminescence element is electrically shorted, and thus it becomes possible to restore the brightness of the luminescence element that has deteriorated with the passage of time.

Furthermore, a period in which the predetermined bias voltage is applied to the one of the anode and the cathode of the luminescence element may be set alternately with a period in which one of the write control lines controls the writing of the signal voltage.

With this, the ratio between the period for writing signal voltage and the period for applying bias voltage can be set arbitrarily, and thus optimization of the brightness restoration measure suited to the display specifications becomes possible.

Furthermore, a period in which the predetermined bias voltage is applied to the one of the anode and the cathode of the luminescence element may be set alternately with a period in which all of the write control lines control the writing of the signal voltage.

With this, bias voltage is applied collectively in a blanking period in which signal voltage is not written, and thus the period in which signal voltage is written can be set longer. Furthermore, since the operating frequency for bias voltage application and signal voltage writing can be lowered, the influence of the charge-discharge characteristics of bias voltage on the luminescence element can be reduced.

Furthermore, the present invention can be implemented, not only as a display device including such characteristic units, but also as display device driving method having the characteristic units included in the display device as steps.

According to the display device and the driving method thereof in the present invention, part of the basic circuit components for luminescence production is used in-common as an additional circuit required in the application of bias voltage to the luminescence element, and thus the predetermined bias voltage can be provided to the luminescence element without a reduction in manufacturing yield, using a simple pixel circuit configuration. Therefore, the brightness deterioration in the EL element can be reversed while maintaining display quality.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

(First Embodiment)

The display device in the present embodiment includes luminescence elements, data lines, a data driving circuit which supplies signal voltage to the data lines, and a bias supplying circuit which supplies a predetermined bias voltage to the data lines. Each of the luminescence pixels includes a first transistor which converts the signal voltage supplied from a data line into signal voltage, a luminescence element which produces luminescence when signal current flows, a third transistor which switches between conduction and non-conduction between the signal line and the luminescence element, and a capacitance element having one terminal connected to a gate terminal of the first transistor and another terminal connected to a write control line for permitting data writing to a luminescence pixel in a stage that is one row ahead, that is, an immediately preceding luminescence pixel. In a period during which signal current does not flow to the luminescence element, a predetermined bias voltage is applied to one of the anode and the cathode of the luminescence element by making the connection between the data line and the data driving circuit to non-conductive, making the connection between the data line and the bias supplying circuit conductive, and turning ON the third transistor.

With this, an increase in the number of control lines following the application of bias to the luminescence element is suppressed and there is no need to provide a transistor or dedicated control line for controlling the voltage level of the capacitance element, and thus the reversing of brightness deterioration is possible without reducing manufacturing yield.

Hereinafter, an embodiment of the present invention shall be described with reference to the Drawings.

Figure 1:
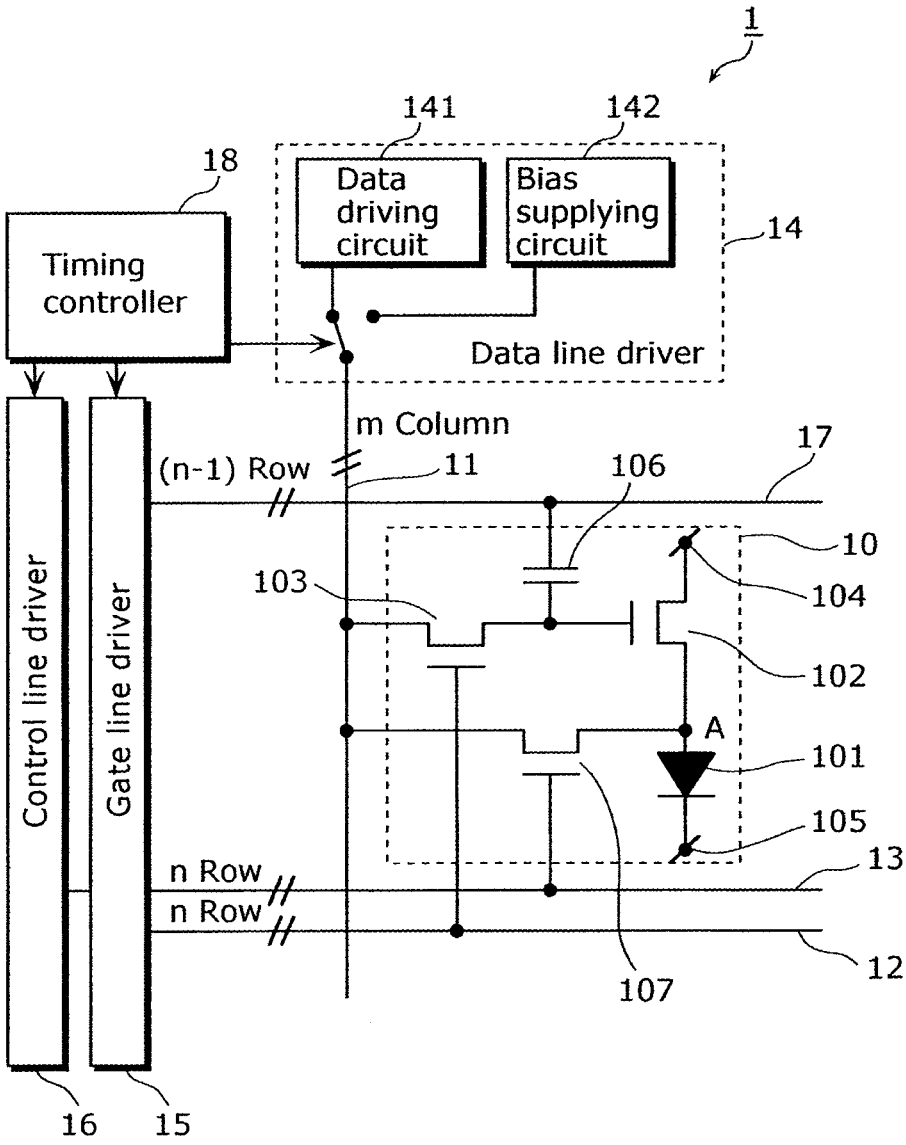
FIG. 1 is a diagram showing the configuration of a luminescence pixel circuit and peripheral circuits thereof in a display device in a first embodiment of the present invention.

FIG. 1 is a diagram showing the configuration of a luminescence pixel circuit and peripheral circuits thereof in a display device in a first embodiment of the present invention. A display device 1 in the figure includes a luminescence pixel 10, a data line 11, gate lines 12 and 17, a control line 13, a data line driver 14, a gate line driver 15, a control line driver 16, and a timing controller 18.

The luminescence pixel 10 is a luminescence pixel which is located at n row and m column among luminescence pixels arranged in a matrix, and has a function for producing luminescence according to signal voltage supplied via the data line 11, and includes a luminescence element 101, a driving transistor 102, switching transistors 103 and 107, power sources 104 and 105, and a capacitance element 106.

The data line 11 is connected to the data line driver 14, and has a function for supplying signal voltage which determines luminescence intensity, to each luminescence pixel in a luminescence pixel column which includes the luminescence element 10 and is the mth column from the left.

Furthermore, the display device 1 includes as many data lines, including the data line 11, as the number of pixel columns.

The gate line 12, which is a first write control line, is connected to the gate line driver 15, and has a function for supplying the timing for writing the signal voltage, to each of the luminescence pixels in a luminescence pixel row which includes the luminescence pixel 10 and is the nth row from the top.

The control line 13, which is a bias control line, is connected to the control line driver 16, and has a function for supplying the timing for writing a predetermined bias voltage, to each of the luminescence pixels in the luminescence pixel row which is arranged in the horizontal direction, includes the luminescence pixel 10, and is the nth row from the top.

Furthermore, the display device 1 includes as many control lines, including the control line 13, as the number of pixel rows.

The data line driver 14 is connected to all the data lines, including the data line 11, and has a function for driving all of the data lines. Furthermore, the data line driver 14 includes a data driving circuit 141 and a bias supplying circuit 142, and connection between the data line 11 and the data driving circuit 141, or connection between the data line 11 and the bias providing circuit 142 is selected according to the timing controller 18.

The data driving circuit 141 has a function for supplying each data line with the signal voltage which causes each luminescence pixel to produce luminescence. In the case of the present embodiment, the level of the signal voltage supplied to each luminescence pixel via the respective data lines is, for example, 2 to 8V.

Furthermore, the bias supplying circuit 142 has a function for providing a reverse bias to the luminescence element included in each luminescence pixel. In the case of the present embodiment, the level of the bias voltage supplied to each luminescence pixel via the respective data lines is, for example, −3 to −5V.

It should be noted that the data driving circuit 141 and the bias supplying circuit 142 need not be disposed as components of the data line driver 14, and may be disposed, as separate components, on the upper portion and the lower portion of plural pixel regions.

The gate line driver 15 is connected to all the gate lines, including the gate lines 12 and 17, and has a function for driving all the gate lines. In the present embodiment, the level of voltage outputted from the gate line driver 15 is, for example, −15 to 12V.

The control line driver 16 is connected to all the control lines, including the control line 13, and has a function for driving all of the control lines. In the present embodiment, the level of voltage outputted from the control line driver 16 is, for example, −5 to 12V.

The gate line 17, which is a second write control line, is connected to the gate line driver 15, and has a function for supplying the timing for writing signal voltage, to a luminescence pixel which is one row ahead and for which writing of signal voltage is to be performed immediately before the writing of signal voltage to the luminescence pixel 10. Furthermore, the gate line 17 has a function for controlling the gate voltage which determines the turning ON/OFF of the driving transistor 102 included in the luminescence pixel 10. This function shall be described later.

Furthermore, the display device 1 includes as many control lines, including the gate lines 12 and 17, as the number of pixel rows.

The timing controller 18 has a function for supplying the drive timing to the data line driver 14, the gate line driver 15, and the control line driver 16.

Next, the circuit components of the luminescence pixel 10 shall be described.

The luminescence element 101 is an EL (electroluminescence) element having an anode connected to one of a source and a drain of the driving transistor 102, and a cathode connected to the power source 105. The luminescence element 101 has a function for producing luminescence in accordance with the flowing of the signal current resulting from the conversion by the driving transistor 102. The luminescence element 101 is, for example, an organic EL element.

The driving transistor 102 is a first transistor and has a gate connected to the data line 11 via the switching transistor 103, and the other of the source and the drain connected to the power source 104. The driving transistor 102 has a function for converting the signal voltage supplied from the data line 11 into signal current that is commensurate with the size of the signal voltage. The driving transistor 102 is, for example, an n channel FET.

The switching transistor 103 is a second transistor and has a gate connected to the gate line 12, one of a source and a drain connected to the data line 11, and the other of the source and the drain connected to the gate of driving transistor 102. The switching transistor 103 switches between the conduction and non-conduction between the data line 11 and the gate of the driving transistor 102. In other words, the switching transistor 103 has a function for supplying the signal voltage value of the data line 11 to the luminescence pixel 10 during a period in which the gate line 12 is at a high level. The switching transistor 103 is, for example, an n channel FET.

The power source 104 is a constant voltage source of the driving transistor 102, and is set at, for example, 10V.

The power source 105 is a constant voltage source of the luminescence element 101, and is, for example, grounded. In the case of the present embodiment, the potential of the power source 104 is set higher than the potential of the power source 105.

The capacitance element 106 has one terminal connected to the gate of the driving transistor 102 and the other terminal connected to the gate line 17, and has a function for accumulating the signal voltage level supplied via the switching transistor 103. It should be noted that, as previously described, the ON/OFF control for the driving transistor 102 through the changing of the voltage level of the capacitance element 106 shall be described later.

The switching transistor 107 has a gate connected to the control line 13, one of a source and a drain connected to the data line 11, and the other of the source and the drain connected to the anode of the luminescence element 101. The switching transistor 107 switches between the conduction and non-conduction between the data line 11 and the anode of the luminescence element 101. In other words, the switching transistor 107 has a function for supplying a predetermined bias voltage value of the data line 11 to the luminescence pixel 10 during a period in which the control line 13 is at a high level. The switching transistor 107 is, for example, an n channel FET.

Figure 2:
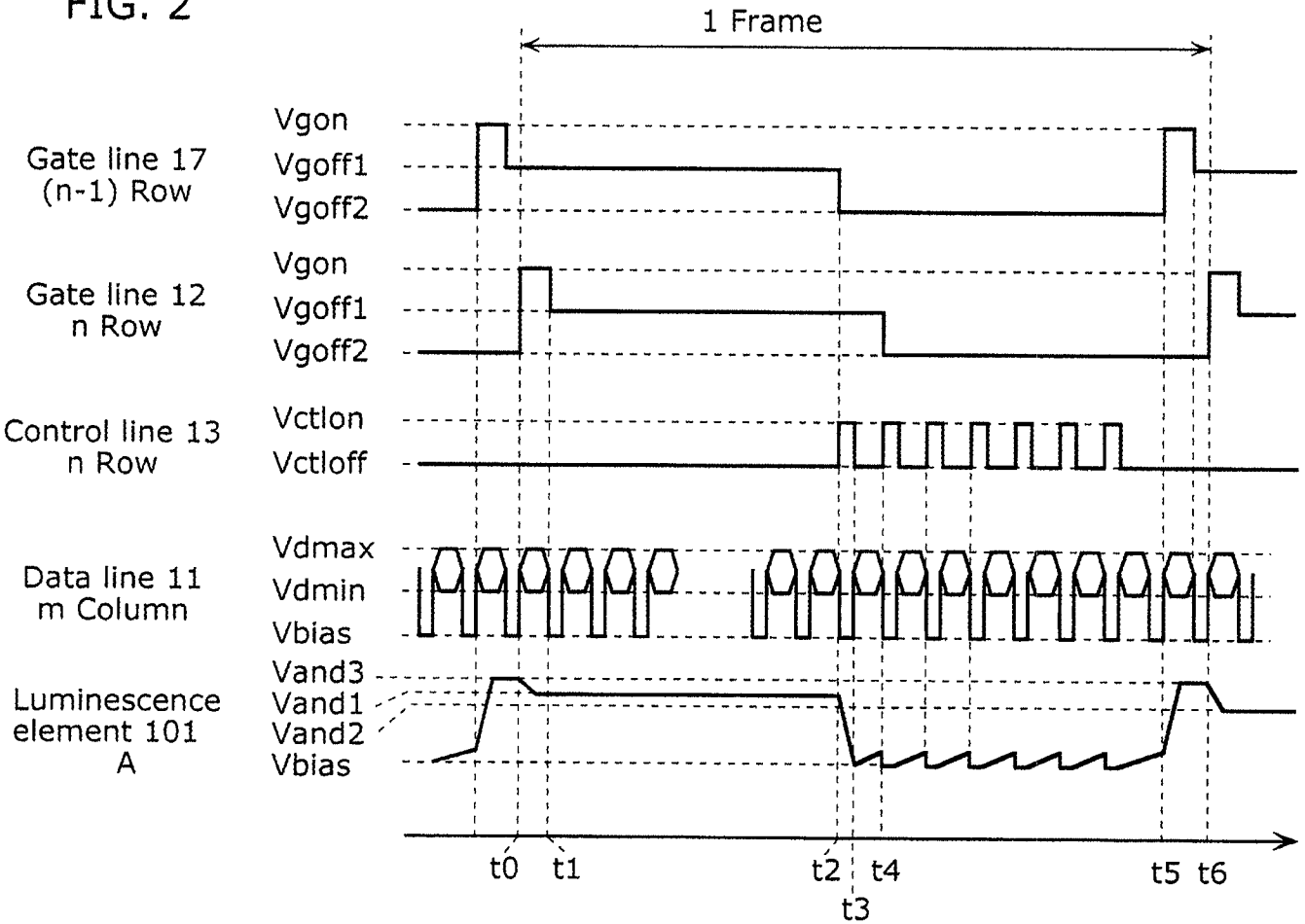
FIG. 2 is an operation timing chart for the display device in the first embodiment of the present invention.

Next, the driving method of the display device 1 in the present embodiment shall be described using FIG. 2 and FIG. 3.

FIG. 2 is an operation timing chart for the display device in the first embodiment of the present invention. In the figure, the horizontal axis denotes time. In addition, the respective waveform charts of the voltage generated in the gate line 17, the gate line 12, the control line 13, the data line 11, and the anode of the luminescence element 101 are shown sequentially from the top, in the vertical direction.

Furthermore, FIGS. 3A to 3D are state transition diagrams of the display device in the first embodiment of the present invention.

First, at a time t0, the voltage level of the gate line 12 is changed from Vgoff2 to Vgon so as to turn ON the switching register 103. It should be noted that, in the present embodiment, Vgon is set at 12V and Vgoff2 is set at −15V, for example.

Figure 3A:
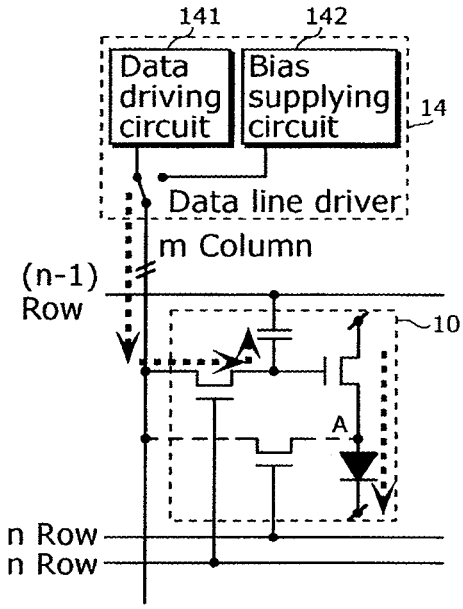
FIGS. 3A to 3D are state transition diagrams for the display device in the first embodiment of the present invention.

During a period t0 to t1, the switching transistor 103 stays ON and, in this period, writes the signal voltage supplied to the data line 11, into the capacitance element 106. FIG. 3A shows the state of the display device 1 in the period t0 to t1. The amount of current flowing to the driving transistor 102 is determined according to the potential difference between the signal voltage value written into the capacitance element 106 and the power source 104, and the luminescence element 101 produces luminescence with a brightness corresponding to such amount of current. At this time, the potential of anode A of the luminescence element 101 becomes a potential Vand1 which is higher than the potential of the power source 105 by as much as the forward voltage of the luminescence element 101 at the time when signal current corresponding to the signal voltage is flowing.

Next, at a time t1, the voltage level of the gate line 12 is changed to Vgoff1 so as to turn OFF the switching transistor 103. It should be noted that, in the present embodiment, Vgoff1 is set at −5V for example.

Figure 3B:
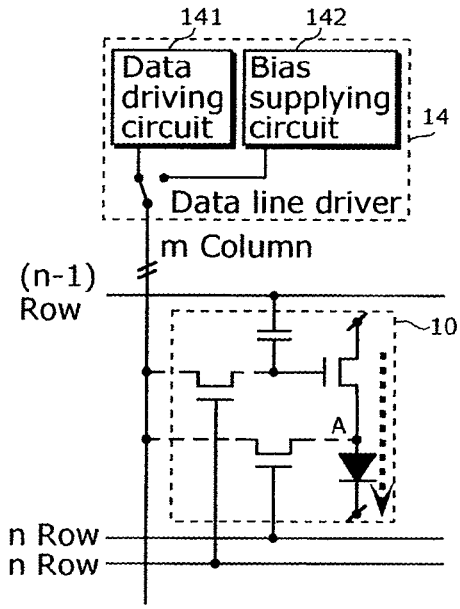

In a period t1 to t2, the luminescence element 101 continues to produce luminescence with the signal current determined according to the potential difference between the signal voltage written into the capacitance element 106 and the power source 104. FIG. 3B shows the state of the display device 1 in the period t1 to t2. The potential of the anode A of the luminescence element 101 is maintained at Vand1.

Next, at a time t2, by changing the voltage level of the gate line 17 to Vgoff2, the gate voltage of the driving transistor 102 changes to the negative side due to capacitance coupling, and the driving transistor 102 is turned OFF. At the same time, since the switching transistor 107 is turned ON by changing the voltage level of the control line 13 to Vctlon, the voltage of the data line 11 is written into the anode of the luminescence element 101. Furthermore, at the time t2, by turning OFF the connection between the data driving circuit 141 and the data line 11 and turning ON the connection between the bias supplying circuit 142 and the data 11 in the data line driver 14, the potential of the anode of the luminescence element 101 changes to a predetermined bias voltage. It should be noted that, in the present embodiment, Vctlon is set at 12V for example.

Figure 3C:
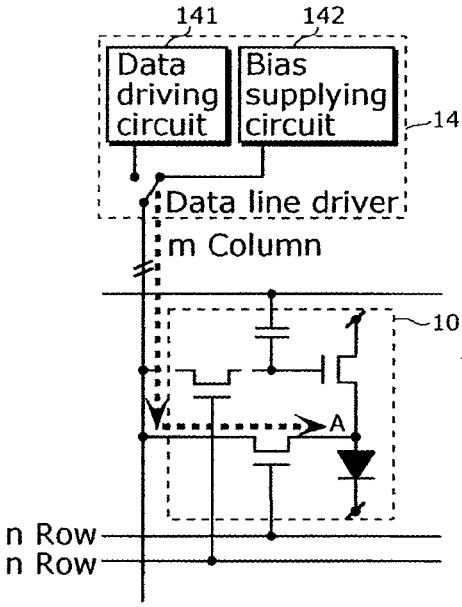

In a period t2 to t3, the potential of the anode of the luminescence element 101 reaches a predetermined bias voltage Vbias. FIG. 3C shows the state of the display device 1 in the period t2 to t3. By setting such Vbias to a voltage lower than the power source 105, a reverse bias can be applied to the luminescence element 101 in the period t2 to t3, and the brightness deterioration in the luminescence element 101 is reversed. It should be noted that, in the present embodiment, Vbias is set at −3 to −5V for example.

Figure 3D:
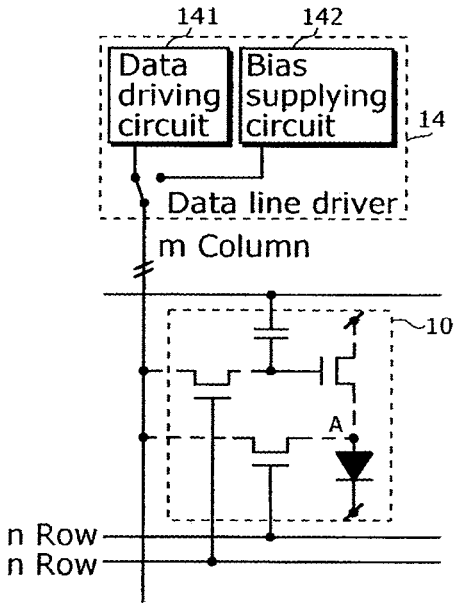

Next, at a time t3, the voltage level of the control line 13 is changed to Vctloff so as to turn OFF the switching transistor 107. At the same time, by turning OFF the connection between the bias supplying circuit 142 and the data 11 and turning ON the connection between the data driving circuit 141 and the data line 11 in the data line driver 14, the data line 11 switches to the signal voltage level which determines the luminescence intensity. At this time, since the potential of the gate line 17 is maintained at Vgoff2, the driving transistor 102 remains turned OFF, and the potential of the anode of the luminescence element 101 is not fixed. It should be noted that, in the present embodiment, Vctloff is set at −5V for example. FIG. 3D shows the state of the display device 1 in the period t3 to t4.

In the case where the pixels connected to the gate line 12 are assumed to be one row, a period t2 to t4 corresponds to the time in which the signal voltage supplied to the data lines is changed on a per row basis, and a period t2 to t3 corresponds to a partial time out of the period in which the signal voltage of a certain row is rewritten. By repeating the period from t2 to 14 by the number of rows of the luminescence pixels of the display device, all of the pixels of the display device 1 are rewritten.

It should be noted that, in the period from t2 to t4, the ratio between the period t2 to t3 and the period t3 to t4 can be adjusted. Specifically, the period in which the driving transistor 102 is turned OFF using the gate line 17, and a bias voltage is applied to the luminescence element 101 using the switching transistor 107 can be set to an arbitrary length within a 1-frame period. With this, optimizing the brightness restoration measure in accordance with the display specifications of the display device becomes possible.

Next, in a period t4 to t5, the period t2 to t4 is repeated so that the driving transistor 102 and the switching transistor 103 are turned OFF, and the switching transistor 107 is periodically turned ON, and thus the predetermined bias voltage Vbias is applied to the anode of the luminescence element 101 such that the reverse bias is kept applied.

Next, at a time t5, by changing the voltage level of the gate line 17 to Vgon, the gate voltage of the driving transistor 102 increases due to the capacitance coupling of the capacitance element 106, and the current determined by the potential difference between the capacitance element 106 and the power source 104 flows once again to the luminescence element 101.

Finally, at a time t6, since the switching transistor 103 is turned ON by changing the voltage level of the gate line 12 to Vgon, a new signal voltage is written into the capacitance element 106, and the luminescence element 101 begins producing luminescence at a new intensity.

The period t0 to t6 corresponds to a 1-frame period in which the luminescence intensity of all the luminescence pixels of the display device 1 is rewritten. Subsequently, the operation in the period t0 to t6 is repeated.

As described above, according to the present embodiment, the display device 1 adopts a simple configuration in which the switching transistor 107 is added to the basic pixel circuit, and the control line 13 which turns the switching transistor 107 ON/OFF is added to each pixel row. Furthermore, the display device 1 includes the control line driver 16, and a data line is used in a time-sharing manner between the two types of writing operations, namely, the writing of pixel data and the writing of bias voltage to a luminescence element. With this configuration, the signal voltage for element luminescence production and the bias voltage for element deterioration reversing can be supplied to the luminescence pixel using the same data line, and furthermore, the voltage level of the capacitance element 106 can be controlled using a gate line of a pixel in the preceding stage, and thus the increase in the control lines or switching transistors accompanying the application of bias to the luminescence element is suppressed. Therefore, since a predetermined bias voltage can be applied to the luminescence elements at a time when luminescence is not produced, without reducing manufacturing yield, it becomes possible to reverse brightness deterioration.

It should be noted that the predetermined bias voltage Vbias can be set to an arbitrary voltage value other than the voltage value of the pixel data. As described in the present embodiment, Vbias may be set to the voltage for applying a reverse bias to the luminescence element 101 or Vbias may be set to the same voltage value as that of the cathode of the luminescence element 101 so as to apply a bias voltage of 0 volts to the luminescence element 101. The brightness deterioration reversing effect can be obtained from all of such voltage values.

Figure 4:
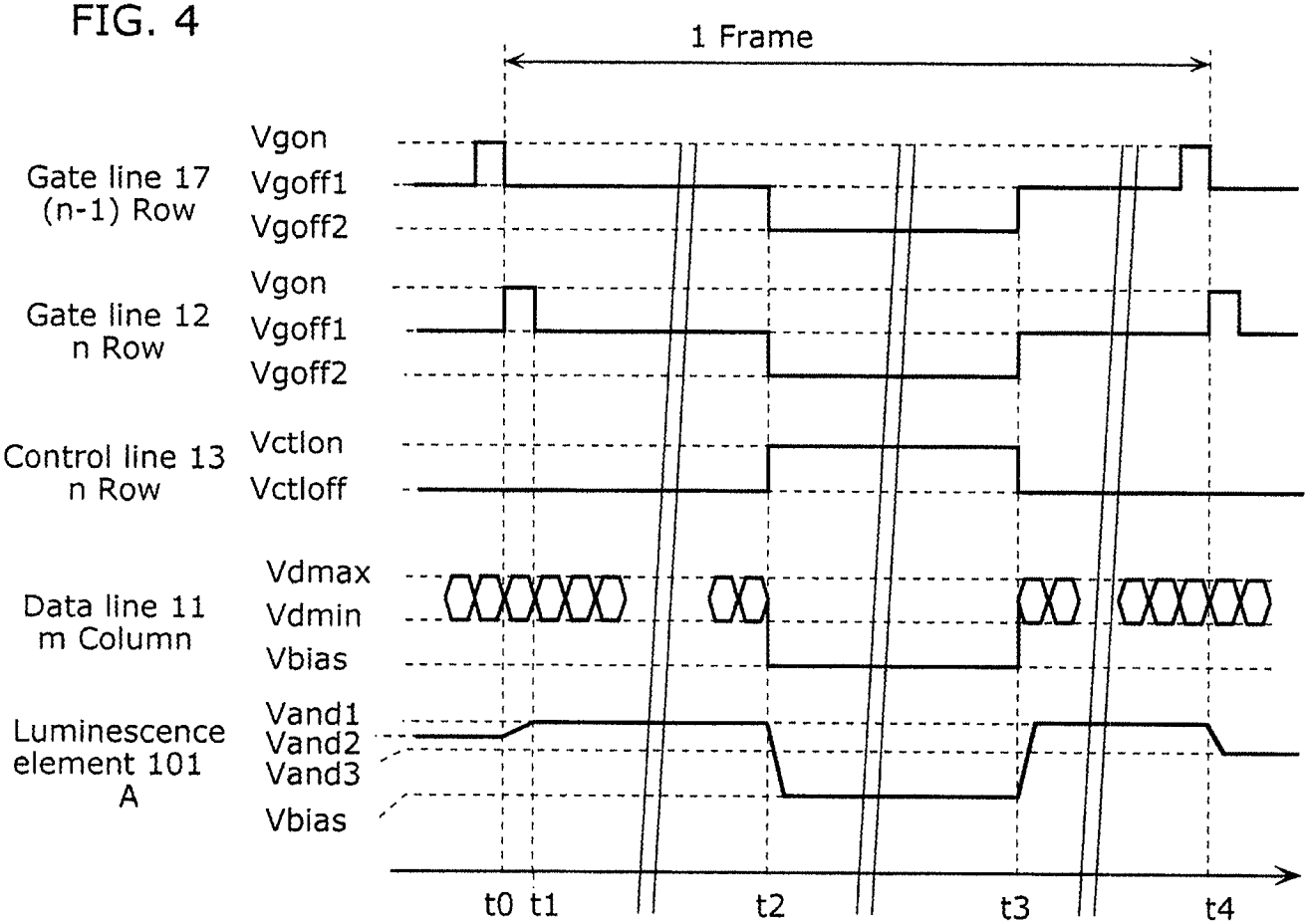
FIG. 4 is an operation timing chart showing a modification of the drive timing of the display device in the first embodiment of the present invention.

FIG. 4 is an operation timing chart showing a modification of the drive timing of the display device in the first embodiment of the present invention.

First, at the time t0, the voltage level of the gate line 12 is changed to Vgon so as to turn ON the switching register 103.

In the period from t0 to t1, the switching transistor 103 stays ON and, in this period, writes the signal voltage supplied to the data line 11, into the capacitance element 106. FIG. 3A shows the state of the display device 1 in the period t0 to t1. The amount of current flowing to the driving transistor 102 is determined according to the potential difference between the signal voltage value written into the capacitance element 106 and the power source 104, and the luminescence element 101 produces luminescence with a brightness corresponding to such amount of current. At this time, the potential of the anode A of the luminescence element 101 becomes the potential Vand1 which is higher than the potential of the power source 105 by as much as the forward voltage of the luminescence element 101 at the time when signal current corresponding to the signal voltage is flowing.

Next, at a time t1, the voltage level of the gate line 12 is changed to Vgoff1 so as to turn OFF the switching transistor 103.

In a period t1 to t2, the luminescence element 101 continues to produce luminescence with the signal current determined according to the potential difference between the signal voltage written into the capacitance element 106 and the power source 104. FIG. 3B shows the state of the display device 1 in the period t1 to t2. The potential of the anode A of the luminescence element 101 is maintained at Vand1.

Next, at the time t2, by changing the voltage level of the gate line 17 from Vgoff1 to Vgoff2, the gate voltage of the driving transistor 102 changes to the negative side due to capacitance coupling, and the driving transistor 102 is turned OFF. At the same time, the voltage level of the control line 13 is changed to Vctlon so that the switching transistor 107 is turned ON, and thus the voltage of the data line 11 is written into the anode of the luminescence element 101. Furthermore, at the time t2, by turning OFF the connection between the data driving circuit 141 and the data line 11 and turning ON the connection between the bias supplying circuit 142 and the data 11 in the data line driver 14, the potential of the anode of the luminescence element 101 changes to a predetermined bias voltage.

Next, upon reaching the time t3, the voltage level of the control line 13 is changed to Vctloff so that the switching transistor 107 is turned OFF, and the data line 11 switches to the signal level which determines luminescence intensity. At the same time, by changing the voltage level of the gate line 17 to Vgoff1, the gate voltage of the driving transistor 102 returns to the same voltage as that in the period t1 to t2 due to the capacitance coupling of the capacitance element 106, and the signal current written at the time t0 flows once again to the luminescence element.

Next, upon reaching the time t4, the voltage level of the gate line 12 is changed to Vgon so that the switching transistor 103 is turned ON, and a new signal voltage is written into the capacitance element 106.

In the above-described modification of the drive timing, since the period for applying the reverse bias to the capacitance element 106 using the time-sharing of the data line 11 is a blanking period in which luminescence intensity is not written, setting this period freely is difficult but, inversely, it is possible to secure a long display period in which luminescence intensity is written.

In such manner, according to the driving method for the display device according to the present embodiment, the period in which bias voltage is applied to the luminescence element 101 may be set alternately with the period in which signal voltage for producing luminescence is written for one row via each data line, and may be set within a blanking period provided within one frame. The drive timing to be selected is determined in accordance with the display specifications of the display device or the deterioration characteristics of the luminescence elements.

(Second Embodiment)

Figure 5:
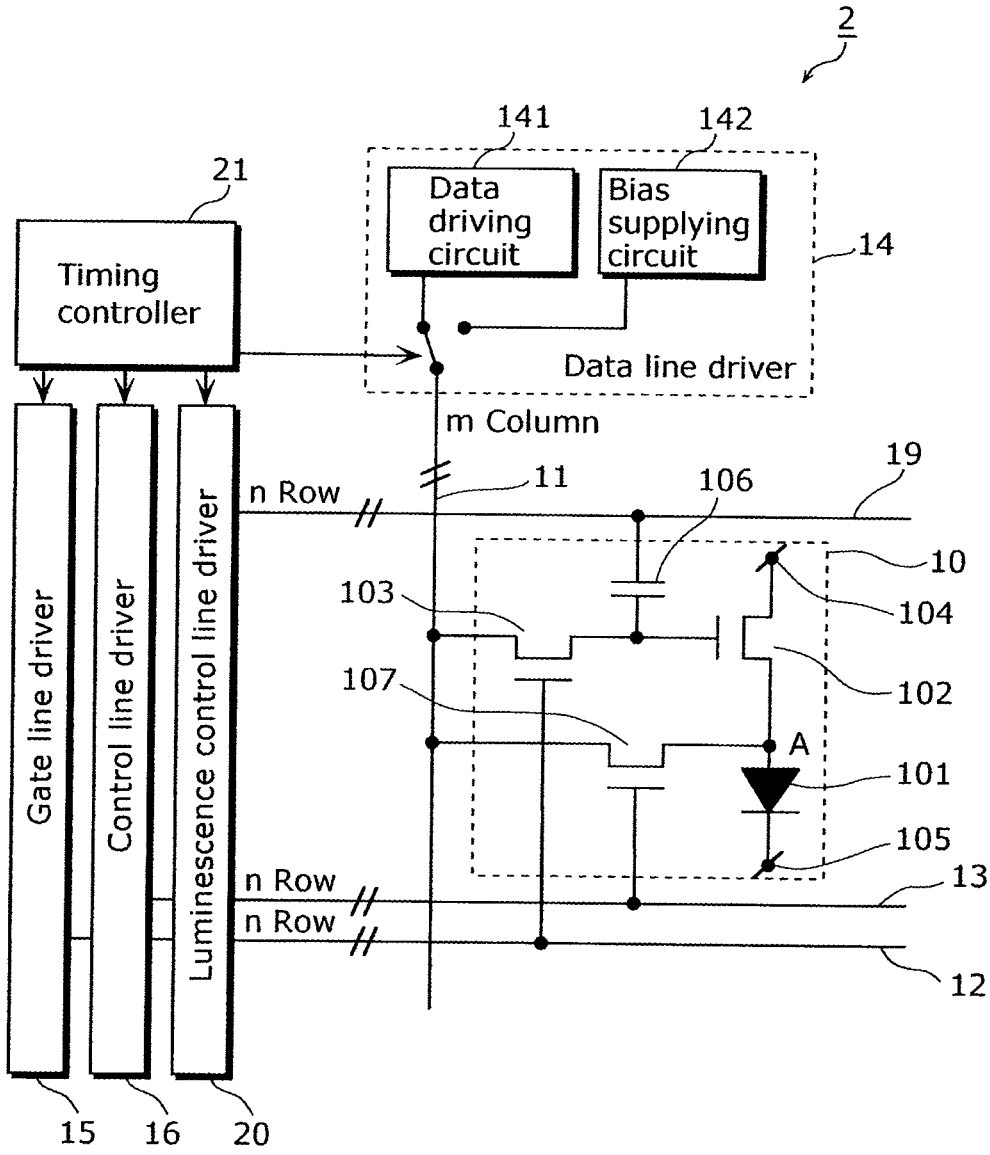
FIG. 5 is a diagram showing the configuration of a luminescence pixel circuit and peripheral circuits thereof in a display device in a second embodiment of the present invention.

FIG. 5 is a diagram showing the configuration of a luminescence pixel circuit and peripheral circuits thereof in a display device in a second embodiment of the present invention. A display device 2 in the figure includes the luminescence pixel 10, the data line 11, the gate line 12, the control line 13, the data line driver 14, the gate line driver 15, the control line driver 16, a luminescence control line 19, a luminescence control line driver 20, and a timing controller 21. Compared with the display device 1 in the first embodiment, the display device 2 in the figure is different, as a circuit configuration, in terms of having the capacitance element 106, which is a component of the luminescence pixel 10, connected to a dedicated luminescence control line instead of being connected to a gate line which is connected to the luminescence pixel in the preceding stage, and in terms of being provided with a luminescence control line driver which drives such luminescence control line. Furthermore, with this point of difference in circuit configurations, the connections and the drive timing of the timing controller which controls each driver are also different. Thus, description of points identical to those in the first embodiment shall be omitted and only the points of difference shall be described hereafter.

The luminescence control line 19 is connected to each luminescence pixel in a luminescence pixel row that is the nth row from the top and to the luminescence control line driver 20, and has a function for controlling the voltage level of the capacitance element 106 connected to the gate of the driving transistor 102 included in the luminescence pixel 10.

The luminescence control line driver 20 is connected to all the luminescence control lines, including the luminescence control line 19, and has a function for driving all of the luminescence control lines.

The timing controller 21 has a function for supplying the drive timing to the data line driver 14, the gate line driver 15, the control line driver 16, and the luminescence control line driver 20.

The capacitance element 106 has one terminal connected to the gate of the driving transistor 102 and the other terminal connected to the luminescence control line 19, and has a function for accumulating the signal voltage level supplied via the switching transistor 103. It should be noted that the ON/OFF control for the driving transistor 102 through the changing of the voltage level of the capacitance element 106 shall be described later.

Figure 6:
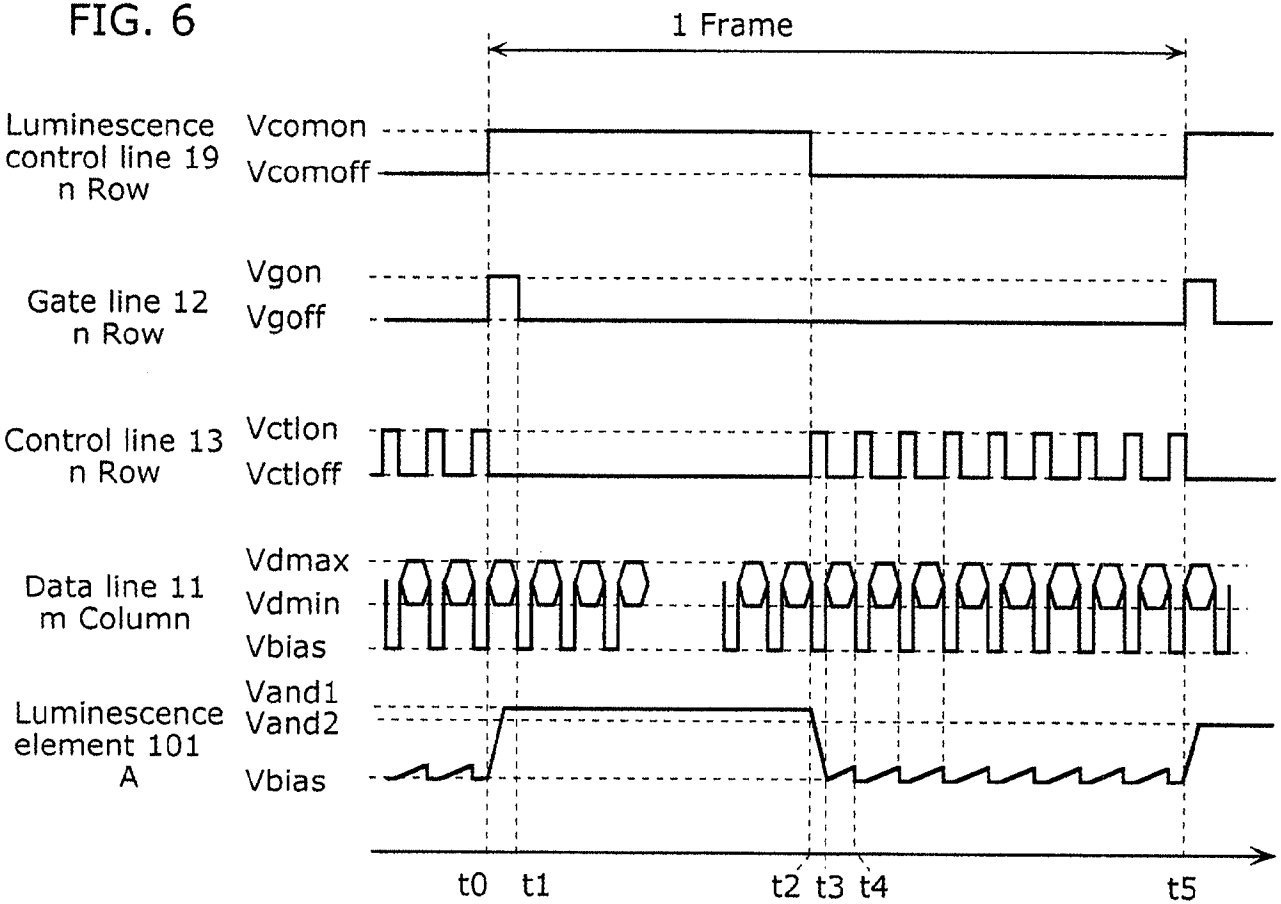
FIG. 6 is an operation timing chart for the display device in the second embodiment of the present invention.

Next, the driving method of the display device 2 in the present embodiment shall be described using FIG. 6.

FIG. 6 is an operation timing chart for the display device in the second embodiment of the present invention. In the figure, the horizontal axis denotes time. In addition, the respective waveform charts of the voltage generated in the luminescence control line 19, the gate line 12, the control line 13, the data line 11, and the anode of the luminescence element 101 are shown sequentially from the top, in the vertical direction.

First, at a time t0, the voltage level of the gate line 12 is changed from Vgoff to Vgon so as to turn ON the switching register 103. At the same time, the voltage level of the luminescence control line 19 is changed from Vcomoff to Vcomon.

In the period from t0 to t1, the switching transistor 103 stays ON and, in this period, writes the signal voltage supplied to the data line 11, into the capacitance element 106. The amount of current flowing to the driving transistor 102 is determined according to the potential difference between the signal voltage value written into the capacitance element 106 and the power source 104, and the luminescence element 101 produces luminescence with a brightness corresponding to such amount of current. At this time, the potential of anode A of the luminescence element 101 becomes a potential Vand1 which is higher than the potential of the power source 105 by as much as the forward voltage of the luminescence element 101 at the time when signal current corresponding to the signal voltage is flowing.

Next, at a time t1, the voltage level of the gate line 12 is changed to Vgoff so as to turn OFF the switching register 103.

In a period t1 to t2, even when the voltage level of the gate line 12 is changed to Vgoff, the luminescence element 101 continues to produce luminescence with the signal current determined according to the potential difference between the signal voltage written into the capacitance element 106 and the power source 104.

Next, at a time t2, by changing the voltage level of the luminescence control line 19 from Vcomon to Vcomoff, the gate voltage of the driving transistor 102 changes to the negative side due to capacitance coupling, and the driving transistor 102 is turned OFF. At the same time, the voltage level of the control line 13 is changed to Vctlon so that the switching transistor 107 is turned ON, and thus the voltage of the data line 11 is written into the anode of the luminescence element 101. Furthermore, at the time t2, by turning OFF the connection between the data driving circuit 141 and the data line 11 and turning ON the connection between the bias supplying circuit 142 and the data 11 in the data line driver 14, the potential of the anode of the luminescence element 101 changes to a predetermined bias voltage.

In a period t2 to t3, the potential of the anode of the luminescence element 101 reaches a predetermined bias voltage Vbias. By setting such Vbias to a voltage lower than the power source 105, a reverse bias can be applied to the luminescence element 101 in the period t2 to t3, and the brightness deterioration in the luminescence element 101 is reversed.

Next, at a time t3, the voltage level of the control line 13 is changed to Vctloff so as to turn OFF the switching transistor 107. At the same time, by turning OFF the connection between the bias supplying circuit 142 and the data 11 and turning ON the connection between the data driving circuit 141 and the data line 11 in the data line driver 14, the data line 11 switches to the signal voltage level which determines the luminescence intensity. At this time, since the voltage level of the luminescence control line 19 is maintained at Vcomoff, the driving transistor 102 remains turned OFF, and the potential of the anode of the luminescence element 101 is not fixed.

In the case where the pixels connected to the gate line 12 are assumed to be one row, a period t2 to t4 corresponds to the time in which the signal voltage supplied to the data lines is changed on a per row basis, and a period t2 to t3 corresponds to a partial time out of the period in which the signal voltage of a certain row is rewritten. By repeating the period from t2 to t4 by the number of rows of the luminescence pixels of the display device, all the pixels of the display device 1 are rewritten.

It should be noted that, in the period from t2 to t4, the ratio between the period t2 to t3 and the period t3 to t4 can be adjusted. Specifically, the period in which the driving transistor 102 is turned OFF using the gate line 17, and a bias voltage is applied to the luminescence element 101 using the switching transistor 107 can be set to an arbitrary length within a 1-frame period. With this, optimizing the brightness restoration measure in accordance with the display specifications of the display device becomes possible.

Next, in a period t4 to t5, the period t2 to t4 is repeated so that the driving transistor 102 and the switching transistor 103 are turned OFF, and the switching transistor 107 is periodically turned ON, and thus the predetermined bias voltage Vbias is applied to the anode of the luminescence element 101 such that the reverse bias is kept applied.

Next, at time t5, by changing the voltage level of the gate line 12 to Vgon, the switching transistor 103 is turned ON, a new signal voltage is written into the capacitance element 106, and the luminescence element 101 begins producing luminescence at a new intensity. At this time, the potential of the anode of the luminescence element 101 becomes a potential Vand2 which corresponds to the new luminescence intensity.

The period t0 to t5 corresponds to a 1-frame period in which the luminescence intensity of all the luminescence pixels of the display device 2 is rewritten. Subsequently, the operation in the period t0 to t5 is repeated.

As described above, according to the present embodiment, the display device 2 adopts a simple configuration in which the switching transistor 107 is added to the pixel circuit, and the control line 13 which turns the switching transistor 107 ON/OFF and the luminescence control line 19 for controlling the voltage level of the capacitance element 106 are added to each pixel row. Furthermore, the display device 2 includes the control line driver 16 and the luminescence control line driver 20, and a data line 11 is used in a time-sharing manner between the two types of writing operations, namely, the writing of pixel data and the writing of bias voltage to the luminescence element 101. With this configuration, the signal voltage for element luminescence production and the bias voltage for element deterioration reversing can be supplied to the luminescence pixel using the same data line, and furthermore, the voltage level of the capacitance element can be controlled using the above-described luminescence control line provided in each pixel row, and thus the increase in the control lines or switching transistors accompanying the application of bias to the luminescence elements is suppressed. Therefore, since a predetermined bias voltage can be applied to the luminescence elements at a time when luminescence is not produced, without reducing manufacturing yield, it becomes possible to reverse brightness deterioration.

It should be noted that the predetermined bias voltage Vbias can be set to an arbitrary voltage value other than the voltage value of the pixel data. As described in the present embodiment, Vbias may be set to the voltage for applying a reverse bias to the luminescence element 101 or Vbias may be set to the same voltage value as that of the cathode of the luminescence element 101 so as to apply a bias voltage of 0 volts to the luminescence element 101. The brightness deterioration reversing effect can be obtained from all of such voltage values. Furthermore, since the above-mentioned luminescence control line is added specifically for restoring the brightness of the luminescence element, it is sufficient for the control voltage levels of the luminescence control line to be a binary for turning the driving transistor ON and OFF, and thus the gate line driver can be simplified compared to that in the display device 1 in the first embodiment.

Furthermore, in the present embodiment, during the period in which reverse bias voltage is applied to the luminescence element 101, a potential corresponding to the luminescence intensity is held in the capacitance element 106. Therefore, in the same manner as in the modification to the drive timing of the display device 1 in the first embodiment, even without the rewriting of signal voltage by the switching transistor 103 after the application of reverse bias voltage, the luminescence pixel 10 can be restored to its original luminescence intensity by changing the voltage level of the luminescence control line 19.

(Third Embodiment)

Figure 7:
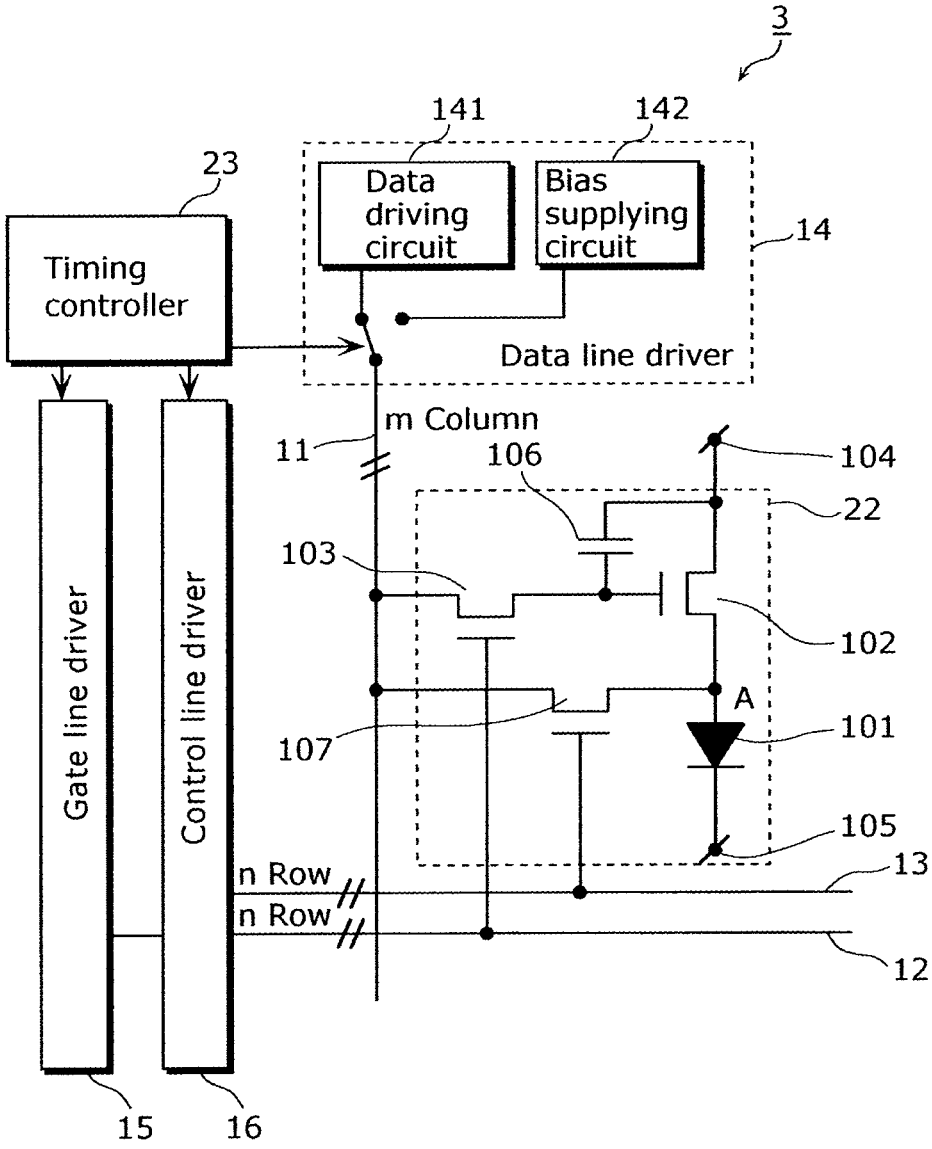
FIG. 7 is a diagram showing the configuration of a luminescence pixel circuit and peripheral circuits thereof in a display device in a third embodiment of the present invention.

FIG. 7 is a diagram showing the configuration of a luminescence pixel circuit and peripheral circuits thereof in a display device in a third embodiment of the present invention. A display device 3 in the figure includes a luminescence pixel 22, the data line 11, the gate line 12, the control line 13, the data line driver 14, the gate line driver 15, the control line driver 16, and a timing controller 23. Compared with the display device 1 in the first embodiment, the display device 3 in the figure is different, as a circuit configuration, in that the capacitance element 106, which is a component of the luminescence pixel 22, is connected to the other of the source and drain of the driving transistor 102 instead of being connected to a gate line which is connected to the luminescence pixel in the preceding stage. Furthermore, with the difference in this circuit configuration, the drive timing of the timing controller which drives each driver is different. Thus, description of points identical to those in the first embodiment shall be omitted and only the points of difference shall be described hereafter.

The timing controller 23 has a function for supplying the drive timing to the data line driver 14, the gate line driver 15, and the control line driver 16.

The capacitance element 106 has one terminal connected to the gate of the driving transistor 102 and the other terminal connected to the other of the source and the drain of the driving transistor 102, and has a function for accumulating the signal voltage level supplied via the switching transistor 103. Here, the voltage level of the capacitance element 106 changes only according to the change in the voltage written therein from the data line 11 via the switching transistor 103. The ON/OFF control for the driving transistor 102 shall be described later.

Figure 8:
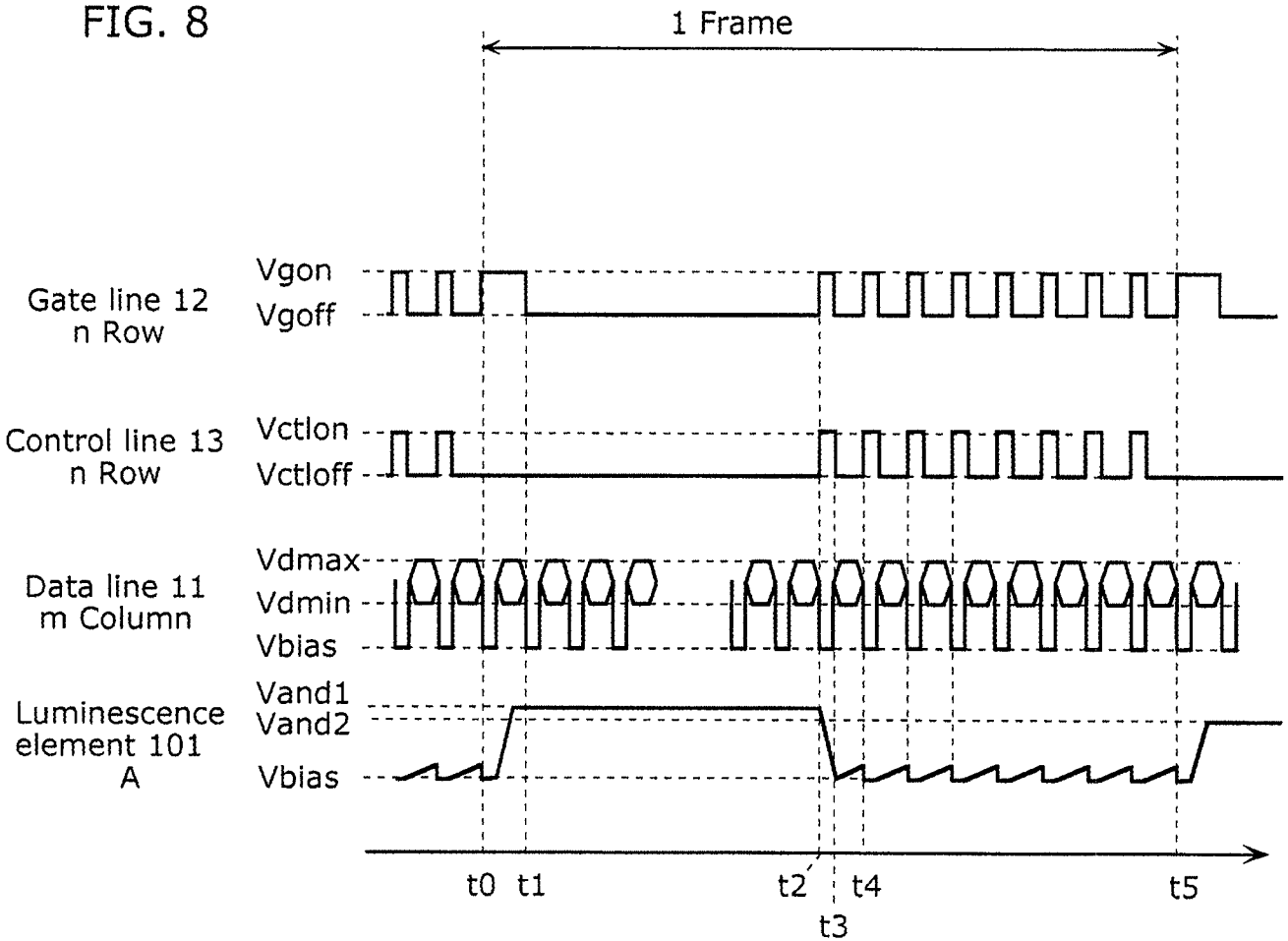
FIG. 8 is an operation timing chart for the display device in the third embodiment of the present invention.

Next, the driving method of the display device 3 in the present embodiment shall be described using FIG. 8.

FIG. 8 is an operation timing chart for the display device in the third embodiment of the present invention. In the figure, the horizontal axis denotes time. In addition, the respective waveform charts of the voltage generated in the gate line 12, the control line 13, the data line 11, and the anode of the luminescence element 101 are shown sequentially from the top, in the vertical direction.

First, at a time t0, the voltage level of the gate line 12 is changed from Vgoff to Vgon so as to turn ON the switching register 103.

In the period from t0 to t1, the switching transistor 103 stays ON and, in this period, writes the signal voltage supplied to the data line 11, into the capacitance element 106. The amount of current flowing to the driving transistor 102 is determined according to the potential difference between the signal voltage value written into the capacitance element 106 and the power source 104, and the luminescence element 101 produces luminescence with a brightness corresponding to such amount of current. At this time, the potential of anode A of the luminescence element 101 becomes a potential Vand1 which is higher than the potential of the power source 105 by as much as the forward voltage of the luminescence element 101 at the time when signal current corresponding to the signal voltage is flowing.

Next, at a time t1, the voltage level of the gate line 12 is changed to Vgoff so as to turn OFF the switching register 103.

In a period t1 to t2, even when the voltage level of the gate line 12 is changed to Vgoff, the luminescence element 101 continues to produce luminescence with the signal current determined according to the potential difference between the signal voltage written into the capacitance element 106 and the power source 104.

Next, at a time t2, the switching register 103 is turned ON by the changing of the voltage level of the gate line 12 from Vgoff to Vgon. At the same time, the voltage level of the control line 13 is changed from Vctloff to Vctlon so as to turn ON the switching transistor 107. Furthermore, at the same time, in the data line driver 14, the connection between the data driving circuit 141 and the data line 11 is turned OFF and the connection between the bias supplying circuit 142 and the data 11 is turned ON. Accordingly, the voltage Vbias supplied from the bias supplying circuit 142 is written into the capacitance element 106 and, at the same time, Vbias is also applied to the anode of the luminescence element 101.

By setting the Vbias voltage value to the voltage value which turns OFF the driving transistor 102 when applied to the gate of the driving transistor 102, and setting it to a voltage value lower than the power source 105 connected to the cathode of the luminescence element 101, a reverse bias can be applied to the luminescence element 101 without causing the luminescence element 101 to produce luminescence in the period t2 to t3.

Next, at a time t3, the switching transistor 103 is turned OFF by changing the voltage level of the gate line 12 from Vgon to Vgoff. At the same time, the voltage level of the control line 13 is changed to Vctloff so as to turn OFF the switching transistor 107. Furthermore, at the same time, by turning OFF the connection between the bias supplying circuit 142 and the data 11 and turning ON the connection between the data driving circuit 141 and the data line 11 in the data line driver 14, the data line 11 switches to the signal level which determines the luminescence intensity. At this time, since the driving transistor 102 remains turned OFF, the potential of the anode of the luminescence element 101 is not fixed.

Next, at a time t4, by turning ON the switching transistors 103 and 107 again, and at the same time, turning OFF the connection between the data driving circuit 141 and the data line 11 and turning ON the connection between the bias supplying circuit 142 and the data 11 in the data line driver 14, Vbias is applied to the anode of the luminescence element 101, and thus the difference voltage between Vbias and the power source 105 is applied to the luminescence element 101.

In the case where the pixels connected to the gate line 12 are assumed to be one row, a period t2 to t4 corresponds to the time in which the signal voltage supplied to the data lines is changed on a per row basis, and a period t2 to t3 corresponds to a partial time out of the period in which the signal voltage of a certain row is rewritten. By repeating the period from t2 to t4 by the number of rows of the luminescence pixels of the display device, all the pixels of the display device 1 are rewritten.

It should be noted that, in the period from t2 to t4, the ratio between the period t2 to t3 and the period t3 to t4 can be adjusted. Specifically, the period in which bias voltage is applied to the luminescence element 101 using the switching transistor 107 can be set to an arbitrary length within a 1-frame period. With this, optimizing the brightness restoration measure in accordance with the display specifications of the display device becomes possible.

Next, in a period t4 to t5, the period t2 to t4 is repeated so that the driving transistor 102 is turned OFF and the switching transistors 103 and 107 are periodically turned ON, and thus Vbias is applied to the capacitance element 106 and the anode of the luminescence element 101 such that the reverse bias is kept applied.

Next, at time t5, by changing the voltage level of the gate line 12 to Vgon, the switching transistor 103 is turned ON. In addition, a new signal voltage is written into the capacitance element 106, and the luminescence element 101 begins producing luminescence at a new intensity. At this time, the potential of the anode of the luminescence element 101 becomes a potential Vand2 which corresponds to the new luminescence intensity.

The period t0 to t5 corresponds to a 1-frame period in which the luminescence intensity of all the luminescence pixels of the display device 3 is rewritten. Subsequently, the operation in the period t0 to t5 is repeated.

As described above, according to the present embodiment, the display device 3 adopts a simple configuration in which the switching transistor 107 is added to the pixel circuit, and the control line 13 which turns the switching transistor 107 ON/OFF is added to each pixel row. Furthermore, the display device 3 includes the control line driver 16, and the data line 11 is used in a time-sharing manner between the two types of writing operations, namely, the writing of pixel data and the writing of bias voltage to the luminescence element 101. Furthermore, by sharing the bias voltage applied to the luminescence element 101 with the level which turns OFF the driving transistor 102, simplification of the above-described circuit configuration can be implemented.

According to this configuration, since a predetermined bias voltage can be applied to the luminescence elements at a time when luminescence is not produced, without reducing manufacturing yield, it becomes possible to reverse brightness deterioration.

It should be noted that the predetermined bias voltage Vbias can be set to an arbitrary voltage value other than the voltage value of the pixel data. As described in the present embodiment, Vbias may be set to the voltage for applying a reverse bias to the luminescence element 101 or Vbias may be set to the same voltage value as that of the cathode of the luminescence element 101 so as to apply a bias voltage of 0 volts to the luminescence element 101. The brightness deterioration reversing effect can be obtained from all of such voltage values. It should be noted that, by sharing the bias voltage applied to the luminescence element 101 with the level which turns OFF the driving transistor 102, it is sufficient for the control voltage level to be a binary for turning the driving transistor ON and OFF, and thus the gate line driver can be simplified as compared to that in the display device 1 in the first embodiment.

(Fourth Embodiment)

Figure 9:
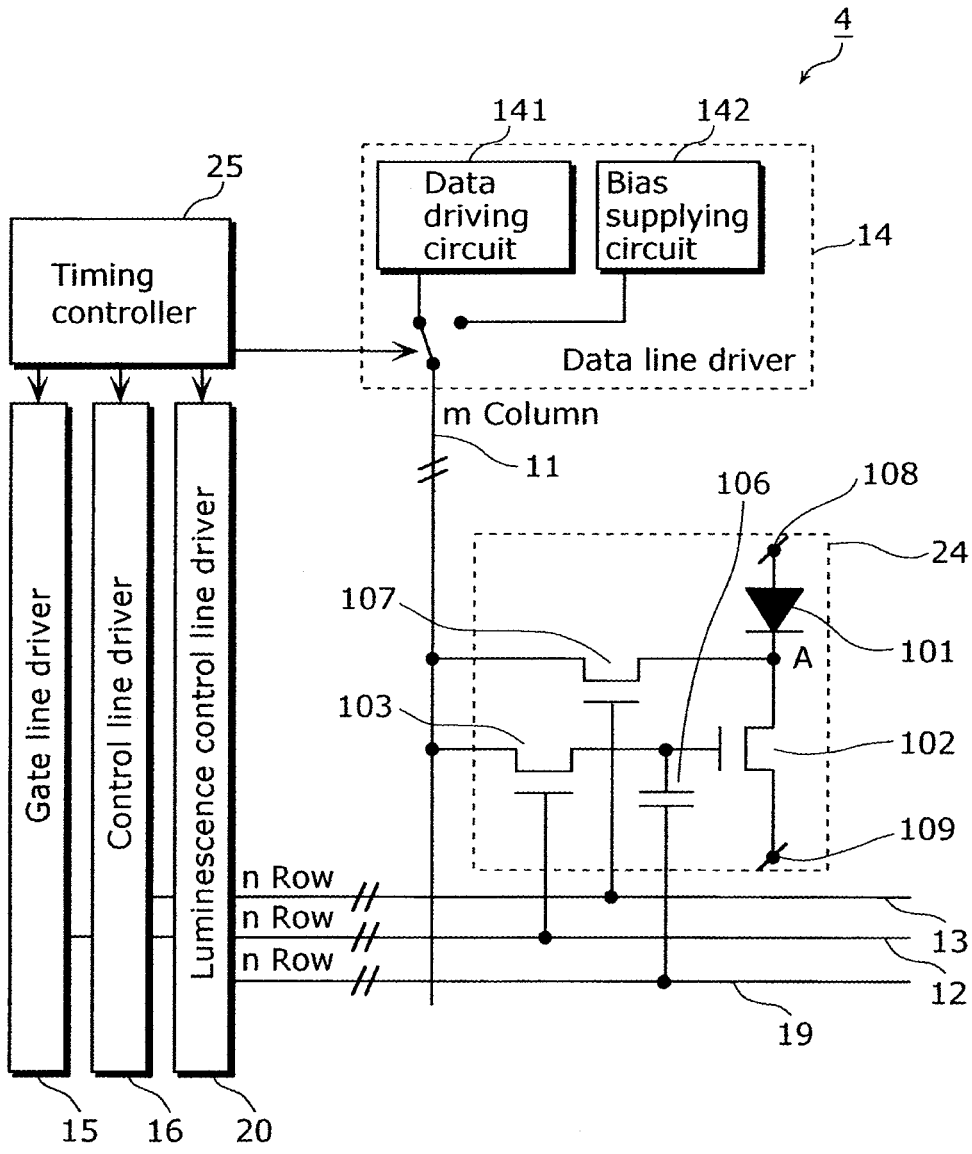
FIG. 9 is a diagram showing the configuration of a luminescence pixel circuit and peripheral circuits thereof in a display device in a fourth embodiment of the present invention.

FIG. 9 is a diagram showing the configuration of a luminescence pixel circuit and peripheral circuits thereof in a display device in a fourth embodiment of the present invention. A display device 4 in the figure includes a luminescence pixel 24, the data line 11, the gate line 12, the control line 13, the data line driver 14, the gate line driver 15, the control line driver 16, the luminescence control line 19, the luminescence control line driver 20, and a timing controller 25. Compared with the display device 2 in the second embodiment, in the display device 4 in the figure, the connections of the luminescence element 101, the driving transistor 102, the switching transistor 107, a power source 108 and a power source 109, which are components of the luminescence pixel 24, are different. Furthermore, with this point of difference in circuit configurations, the connections and the drive timing of the timing controller which controls each driver are also different. Description of points identical to those in the second embodiment shall be omitted and only the points of difference shall be described hereafter.

The luminescence pixel 24 is one among luminescence pixels arranged in a matrix, and has a function for producing luminescence according to signal voltage supplied via the data line 11, and includes the luminescence element 101, the driving transistor 102, the switching transistors 103 and 107, the power sources 108 and 109, and the capacitance element 106.

The data line 11 has a function for supplying signal voltage which determines luminescence intensity, to each luminescence pixel in a luminescence pixel column which includes the luminescence element 24 and is the mth column from the left.

The gate line 12 has a function for supplying the timing for writing the signal voltage, to each of the luminescence pixels in a luminescence pixel row which includes the luminescence pixel 24 and is the nth row from the top.

The control line 13 has a function for supplying the timing for writing a predetermined bias voltage, to each of the luminescence pixels in the luminescence pixel row which is arranged in the horizontal direction and includes the luminescence pixel 10.

In the data line driver 14, the connection between the data line 11 and the data driving circuit 141, or the connection between the data line 11 and the bias providing circuit 142 is selected according to the timing controller 25.

The gate line driver 15 is connected to all the gate lines, including the gate lines 12, and has a function for driving all the gate lines.

The luminescence control line 19 is connected to each luminescence pixel in a luminescence pixel row that is the nth row from the top and to the luminescence control line driver 20, and has a function for controlling the voltage level of the capacitance element 106 connected to the gate of the driving transistor 102 included in the luminescence pixel 24.

The timing controller 25 has a function for supplying the drive timing to the data line driver 14, the gate line driver 15, the control line driver 16, and the luminescence control line driver 20.

Next, the circuit components of the luminescence pixel 24 shall be described.

The luminescence element 101 is an EL element having a cathode connected to one of the source and the drain of the driving transistor 102, and an anode connected to the power source 108.

The driving transistor 102 is a first transistor and has a gate connected to the data line 11 via the switching transistor 103, and the other of the source and the drain connected to the power source 109.

In the case of the present embodiment, the potential of the power source 108 is set higher than the potential of the power source 109.

The switching transistor 107 has a gate connected to the control line 13, one of a source and a drain connected to the data line 11, and the other of the source and the drain connected to the cathode of the luminescence element 101. The switching transistor 107 switches between the conduction and non-conduction between the data line 11 and the cathode of the luminescence element 101.

Figure 10:
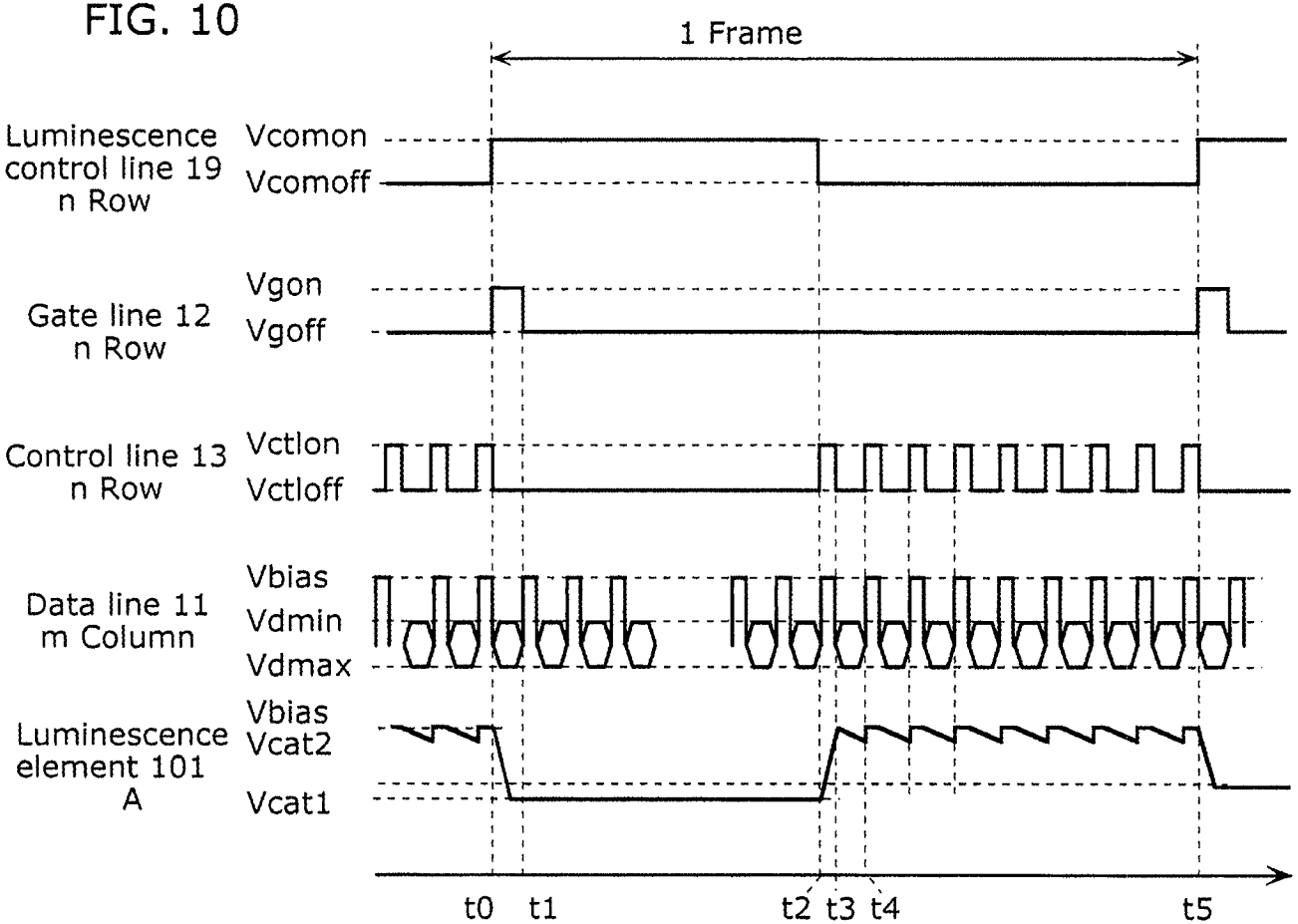
FIG. 10 is an operation timing chart for the display device in the fourth embodiment of the present invention.

Next, the driving method of the display device 4 in the present embodiment shall be described using FIG. 10.

FIG. 10 is an operation timing chart for the display device in the fourth embodiment of the present invention. In the figure, the horizontal axis denotes time. In addition, the respective waveform charts of the voltage generated in the luminescence control line 19, the gate line 12, the control line 13, the data line 11, and the cathode of the luminescence element 101 are shown sequentially from the top, in the vertical direction.

First, at a time t0, the voltage level of the gate line 12 is changed from Vgoff to Vgon so as to turn ON the switching register 103. At the same time, the voltage level of the luminescence control line 19 is changed from Vcomoff to Vcomon.

In the period from t0 to t1, the switching transistor 103 stays ON and, in this period, writes the signal voltage supplied to the data line 11, into the capacitance element 106. The amount of current flowing to the driving transistor 102 is determined according to the potential difference between the signal voltage value written into the capacitance element 106 and the power source 109, and the luminescence element 101 produces luminescence with a brightness corresponding to such amount of current. At this time, the potential of the cathode A of the luminescence element 101 becomes the potential Vcat1 which is lower than the potential of the power source 108 by as much as the forward voltage of the luminescence element 101 at the time when signal current corresponding to the signal voltage is flowing.

Next, at a time t1, the voltage level of the gate line 12 is changed to Vgoff so as to turn OFF the switching register 103.

In a period t1 to t2, even when the voltage level of the gate line 12 is changed to Vgoff, the luminescence element 101 continues to produce luminescence with the signal current determined according to the potential difference between the signal voltage written into the capacitance element 106 and the power source 109.

Next, at a time t2, by changing the voltage level of the luminescence control line 19 from Vcomon to Vcomoff, the gate voltage of the driving transistor 102 changes to the negative side due to capacitance coupling, and the driving transistor 102 is turned OFF. At the same time, since the voltage level of the control line 13 is changed to Vctlon so as to turn ON the switching transistor 107, and the voltage of the data line 11 is written into the cathode of the luminescence element 101. Furthermore, at the time t2, by turning OFF the connection between the data driving circuit 141 and the data line 11 and turning ON the connection between the bias supplying circuit 142 and the data 11 in the data line driver 14, the potential of the cathode of the luminescence element 101 changes to a predetermined bias voltage.

In a period t2 to t3, the potential of the cathode of the luminescence element 101 reaches a predetermined bias voltage Vbias. By setting such Vbias to a voltage higher than the power source 108, a reverse bias can be applied to the luminescence element 101 in the period t2 to t3, and the brightness deterioration in the luminescence element 101 is reversed.

Next, at a time t3, the voltage level of the control line 13 is changed to Vctloff so as to turn OFF the switching transistor 107. At the same time, by turning OFF the connection between the bias supplying circuit 142 and the data 11 and turning ON the connection between the data driving circuit 141 and the data line 11 in the data line driver 14, the data line 11 switches to the signal voltage level which determines the luminescence intensity. At this time, since the voltage level of the luminescence control line 19 is maintained at Vcomoff, the driving transistor 102 remains turned OFF, and the potential of the cathode of the luminescence element 101 is not fixed.

In the case where the pixels connected to the gate line 12 are assumed to be one row, a period t2 to t4 corresponds to the time in which the signal voltage supplied to the data lines is changed on a per row basis, and a period t2 to t3 corresponds to a partial time out of the period in which the signal voltage of a certain row is rewritten. By repeating the period from t2 to t4 by the number of rows of the luminescence pixels of the display device, all the pixels of the display device 1 are rewritten.

It should be noted that, in the period from t2 to t4, the ratio between the period t2 to t3 and the period t3 to t4 can be adjusted. Specifically, the period in which the driving transistor 102 is turned OFF using the gate line 17, and a bias voltage is applied to the luminescence element 101 using the switching transistor 107 can be set to an arbitrary length within a 1-frame period. With this, optimizing the brightness restoration measure in accordance with the display specifications of the display device becomes possible.

Next, in a period t4 to t5, the period t2 to t4 is repeated so that the driving transistor 102 and the switching transistor 103 are turned OFF, and the switching transistor 107 is periodically turned ON, and thus the predetermined bias voltage Vbias is applied to the cathode of the luminescence element 101 such that the reverse bias is kept applied.

Next, at time t5, by changing the voltage level of the gate line 12 to Vgon, the switching transistor 103 is turned ON, a new signal voltage is written into the capacitance element 106, and the luminescence element 101 begins producing luminescence at a new intensity. At this time, the potential of the cathode of the luminescence element 101 becomes a potential Vcat2 which corresponds to the new luminescence intensity.

The period t0 to t5 corresponds to a 1-frame period in which the luminescence intensity of all the luminescence pixels of the display device 4 is rewritten. Subsequently, the operation in the period t0 to t5 is repeated.

As described above, according to the present embodiment, the display device 4 adopts a simple configuration in which the switching transistor 107 is added to the pixel circuit, and the control line 13 which turns the switching transistor 107 ON/OFF and the luminescence control line 19 for controlling the voltage level of the capacitance element 106 are added to the each pixel row. Furthermore, the display device 4 includes the control line driver 16 and the luminescence control line driver 20, and a data line 11 is used in a time-sharing manner between the two types of writing operations, namely, the writing of pixel data and the writing of bias voltage to the luminescence element 101. With this configuration, the signal voltage for element luminescence production and the bias voltage for element deterioration reversing can be supplied to the luminescence pixel using the same data line, and furthermore, the voltage level of the capacitance element can be controlled using the above-described luminescence control line provided in each pixel row, and thus the increase in the control lines or switching transistors accompanying the application of bias to the luminescence elements is suppressed. Therefore, since a predetermined bias voltage can be applied to the luminescence elements at a time when luminescence is not produced, without reducing manufacturing yield, it becomes possible to reverse brightness deterioration.

It should be noted that the predetermined bias voltage Vbias can be set to an arbitrary voltage value other than the voltage value of the pixel data. As described in the present embodiment, Vbias may be set to the voltage for applying a reverse bias to the luminescence element 101 or Vbias may be set to the same voltage value as that of the cathode of the luminescence element 101 so as to apply a bias voltage of 0 volts to the luminescence element 101. The brightness deterioration reversing effect can be obtained from all of such voltage values. Furthermore, since the above-mentioned luminescence control line is added specifically for restoring the brightness of the luminescence element, it is sufficient for the control voltage levels of the luminescence control line to be a binary for turning the driving transistor ON and OFF, and thus the gate line driver can be simplified compared to that in the display device 1 in the first embodiment.

Furthermore, in the present embodiment, during the period in which reverse bias voltage is applied to the luminescence element 101, a potential corresponding to the luminescence intensity is held in the capacitance element 106. Therefore, in the same manner as in the modification to the drive timing of the display device 1 in the first embodiment, even without the rewriting of signal voltage by the switching transistor 103 after the application of reverse bias voltage, the luminescence pixel 10 can be restored to its original luminescence intensity by changing the voltage level of the luminescence control line 19.

As described above, with the display device and the driving method thereof according to the present invention, the signal voltage for element luminescence production and the bias voltage for element deterioration reversing can be supplied to the luminescence pixel using the same data line, and thus the increase in the control lines accompanying the application of bias to the luminescence element is suppressed. Furthermore, since the voltage level of the capacitance element controlling the turning ON/OFF of the driving transistor which supplies signal current to the luminescence element is controlled using a control line provided in each pixel row, it is unnecessary to provide a switching transistor for controlling the voltage level of the capacitance element. Therefore, since the additional circuit for applying reverse bias to the luminescence element is simplified, a predetermined bias can be applied to the luminescence element at a time when luminescence is not produced, without reducing the manufacturing yield of the display element, and thus it becomes possible to reverse the brightness deterioration in the luminescence element.

It should be noted that although, in the aforementioned embodiments, description is carried out under the assumption that the switching transistors are n-type transistors which are turned ON when the voltage level of the gate of switching transistor is HIGH, the reverse bias application to the luminescence elements is possible and the same advantageous effect is produced as in the respective embodiments even with a display device in which the switching transistors are formed using a p-type transistor and the polarity of the gate lines, the control lines, and the luminescence control lines are reversed.

It should be noted that the display device in the present invention is not limited to the above-described embodiments. The present invention includes other embodiments implemented through a combination of arbitrary components of the first to fourth embodiments and the modifications thereto, or modifications obtained through the application of various modifications to the first to fourth embodiments and the modifications thereto, that may be conceived by a person of ordinary skill in the art, that do not depart from the essence of the present invention, or various devices in which the display device in the present invention is built into.

For example, the drive timing for applying reverse bias to the luminescence element within the blanking period, described in the modification of the drive timing of the display device in the first embodiment, may be used in the second embodiment and the fourth embodiment.

Furthermore, although the driving transistors and switching transistors are described in the embodiments of the present invention under the premise of being FETs having a gate, a source, and a drain, a bipolar transistor having a base, a collector, and an emitter may be utilized in such transistors. Even in such a case, the same advantageous effect of achieving the object of the present invention is produced.

Figure 11:
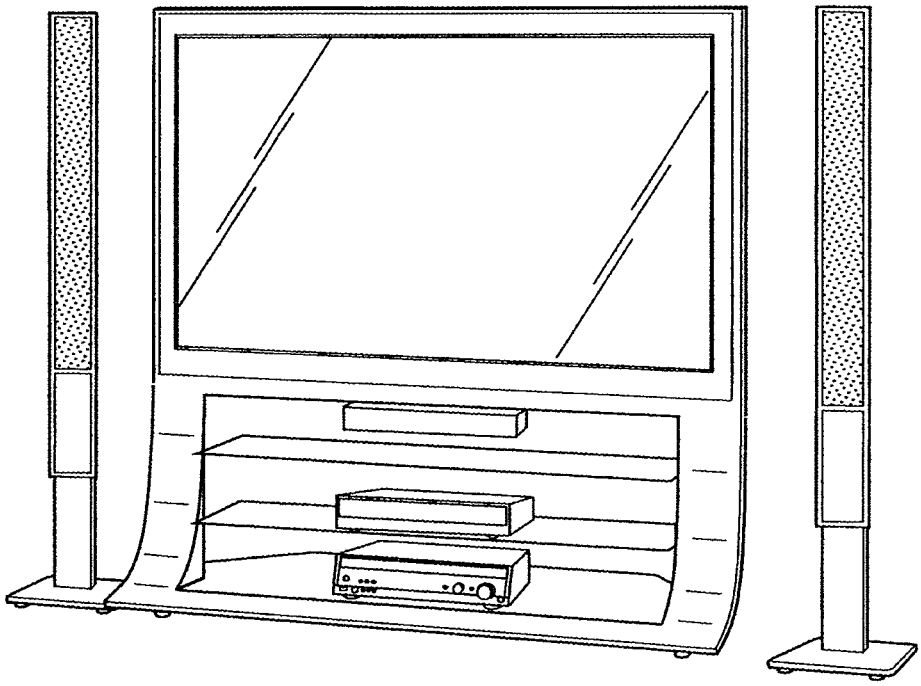
FIG. 11 is an outline view of a flat TV in which the display device in the present invention is built into.
Figure 12:
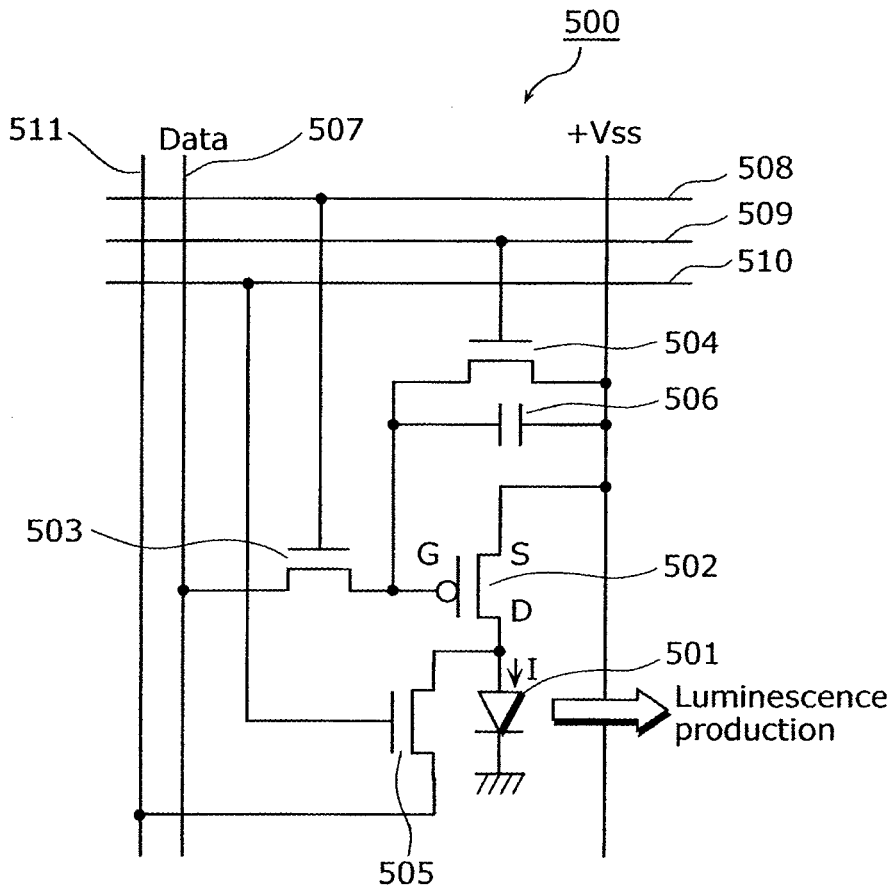
FIG. 12 is a circuit diagram of a luminescence pixel in a conventional display device disclosed in Patent Reference 1.

Furthermore, for example, the display device in the present invention is built into a thin, flat TV shown in FIG. 11. With the display device in the present invention which allows reversing of brightness deterioration, a flat TV equipped with a display having a long operational life and high productivity can be implemented.

INDUSTRIAL APPLICABILITY

The present invention is useful as a display device that is built into an organic EL flat-panel display, and is particularly suited for use as a display device of a display for which low brightness deterioration and long operational life are required.

What is claimed is:

1. A display device, comprising:

luminescence pixels arranged in a matrix;

data lines for determining luminescence of the luminescence pixels;

a data driving circuit that supplies a signal voltage to the data lines; and a bias supplying circuit that supplies a predetermined bias voltage to the data lines, wherein each of the luminescence pixels includes:

a driving transistor that converts the signal voltage supplied from a data line included in the data lines into a signal current;

a luminescence element that produces a luminescence when the signal current flows; and a switching transistor that switches between conduction and non-conduction between the data line and one of an anode and a cathode of the luminescence element, the display device further comprises:

a controller configured to cause a non-conduction state between the data line and the data driving circuit, cause a conduction state between the data line and the bias supplying circuit, and apply the predetermined bias voltage to the one of the anode and the cathode of the luminescence element by switching ON the switching transistor within a period in which the signal current does not flow to the luminescence element, and the predetermined bias voltage is set to a voltage value that restores brightness of the luminescence element affected by brightness deterioration.

2. The display device according to claim 1, wherein the predetermined bias voltage is for applying a reverse bias to the luminescence element.

3. The display device according to claim 2, wherein a value of the reverse bias is from approximately −3 volts to approximately −5volts.

4. The display device according to claim 1, wherein the predetermined bias voltage is for applying a 0-volt bias to the luminescence element.

5. A display device, comprising:

luminescence pixels arranged in a matrix;

data lines for determining luminescence of the luminescence pixels;

a data driving circuit that supplies a signal voltage to the data lines; and a bias supplying circuit that supplies a predetermined bias voltage to the data lines, wherein each of the luminescence pixels includes:

a driving transistor that converts the signal voltage supplied from a data line included in the data lines into a signal current;

a luminescence element that produces a luminescence when the signal current flows; and a switching transistor that switches between conduction and non-conduction between the data line and one of an anode and a cathode of the luminescence element, the display device further comprises:

a controller configured to cause a non-conduction state between the data line and the data driving circuit, cause a conduction state between the data line and the bias supplying circuit, and apply the predetermined bias voltage to the one of the anode and the cathode of the luminescence element by switching ON the switching transistor within a period in which the signal current does not flow to the luminescence element, and the predetermined bias voltage is for applying a 0-volt bias to the luminescence element, and is set to a voltage value that recovers a brightness deterioration of the luminescence element.

6. A driving method of a display device, wherein the display device includes:

luminescence pixels arranged in a matrix;

data lines for determining luminescence of the luminescence pixels;

a data driving circuit that supplies a signal voltage to the data lines; and a bias supplying circuit that supplies a predetermined bias voltage to the data lines, each of the luminescence pixels includes:

a driving transistor that converts the signal voltage supplied from a data line included in the data lines into a signal current;

a luminescence element that produces a luminescence when the signal current flows; and a switching transistor that switches between conduction and non-conduction between the data line and one of an anode and a cathode of the luminescence element, the driving method comprising:

causing, simultaneously, a non-conduction state between the data line and the data driving circuit and a conduction state between the data line and the bias supplying circuit; and applying the predetermined bias voltage to the one of the anode and the cathode of the luminescence element by switching ON the switching transistor within a period in which the signal current does not flow to the luminescence element, wherein the predetermined bias voltage is set to a voltage value that restores brightness of the luminescence element affected by brightness deterioration.

7. The driving method according to claim 6, wherein the predetermined bias voltage applies a reverse bias to the luminescence element.

8. The driving method according to claim 7, wherein a value of the reverse bias is from approximately −3 volts to approximately −5volts.

9. The driving method according to claim 6, wherein the predetermined bias voltage applies a 0-volt bias to the luminescence element.

* * * * *